US007776259B2

(12) United States Patent
Deevi et al.

(10) Patent No.: US 7,776,259 B2
(45) Date of Patent: Aug. 17, 2010

(54) HIGH-STRENGTH HIGH-TEMPERATURE CREEP-RESISTANT IRON-COBALT ALLOYS FOR SOFT MAGNETIC APPLICATIONS

(75) Inventors: Seetharama C. Deevi, Midlothian, VA (US); Rangaraj S. Sundar, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 749 days.

(21) Appl. No.: 11/199,277

(22) Filed: Aug. 9, 2005

(65) Prior Publication Data

US 2007/0289676 A1 Dec. 20, 2007

Related U.S. Application Data

(63) Continuation of application No. 10/314,993, filed on Dec. 10, 2002, now Pat. No. 6,946,097, which is a continuation-in-part of application No. 09/757,625, filed on Jan. 11, 2001, now Pat. No. 6,685,882.

(51) Int. Cl.

| | |
|---|---|
| ***C22C 38/10*** | (2006.01) |
| ***C22C 38/12*** | (2006.01) |
| ***C22C 19/07*** | (2006.01) |
| ***C22C 30/00*** | (2006.01) |

(52) U.S. Cl. ..... 420/581; 420/435; 420/127; 148/311; 148/313; 148/102; 148/120; 148/121; 419/1; 419/69

(58) Field of Classification Search ..... None
See application file for complete search history.

(56) References Cited

U.S. PATENT DOCUMENTS

| | | | | |
|---|---|---|---|---|
| 1,862,559 | A * | 6/1932 | White et al. | 420/127 |
| 2,603,562 | A | 7/1952 | Rapatz | |
| 3,375,105 | A | 3/1968 | Lynch | |
| 3,568,172 | A | 3/1971 | Lesher | |
| 3,622,406 | A | 11/1971 | Vordahl | |
| 3,624,568 | A | 11/1971 | Olsen | |
| 3,634,072 | A | 1/1972 | Ackermann et al. | |
| 3,704,118 | A * | 11/1972 | Stroble | 420/435 |
| 3,891,475 | A | 6/1975 | Tomita et al. | |
| 3,977,919 | A | 8/1976 | Foster et al. | |
| 4,103,195 | A | 7/1978 | Torossian et al. | |
| 4,116,727 | A | 9/1978 | Major | |
| 4,247,601 | A | 1/1981 | Wiegand | |
| 4,439,236 | A | 3/1984 | Ray | |
| 4,647,427 | A | 3/1987 | Liu | |
| 4,743,513 | A | 5/1988 | Scruggs | |
| 4,933,026 | A | 6/1990 | Rawlings et al. | |
| 5,024,542 | A | 6/1991 | Tanaka | |
| 5,032,355 | A | 7/1991 | Achikita et al. | |
| 5,067,993 | A | 11/1991 | Wakita et al. | |
| 5,122,337 | A | 6/1992 | Lund et al. | |
| 5,252,940 | A | 10/1993 | Tanaka | |
| 5,338,508 | A | 8/1994 | Nitta et al. | |
| 5,443,787 | A | 8/1995 | Mori et al. | |
| 5,501,747 | A | 3/1996 | Masteller et al. | |
| 5,503,654 | A | 4/1996 | Takahashi et al. | |
| 5,741,374 | A | 4/1998 | Li | |
| 5,817,191 | A | 10/1998 | Emmerich et al. | |
| 6,146,474 | A | 11/2000 | Coutu et al. | |
| 6,225,556 | B1 | 5/2001 | Saito | |
| 6,685,882 | B2 * | 2/2004 | Deevi et al. | 420/124 |
| 6,946,097 | B2 * | 9/2005 | Deevi et al. | 420/124 |

FOREIGN PATENT DOCUMENTS

| | | | |
|---|---|---|---|
| JP | 50-082592 | | 7/1975 |
| JP | 59-162251 | | 9/1984 |
| JP | 63-004036 | | 1/1988 |
| JP | 01-119642 | A | 5/1989 |
| JP | 01-255645 | A | 10/1989 |
| JP | 09-228007 | A * | 9/1997 |
| JP | 09-228007 | A | 9/1997 |

OTHER PUBLICATIONS

Full English translation of JP 01-119642 A.*

Lee et al. "Powder Metal Technologies and Applications", ASM Handbook vol. 7, 1995, pub. By ASM International, pp. 9-15, 80-90 and 408-419.

Colegrove, Phillip G. et al., "Integrated Power Unit for a More Electric Airplane", AIAA/AHS/ASEE Aerospace Design conference, Feb. 16-19, 1993, Irvine, CA, pp. 1-9.

Fingers, Richard T. et al., Mechanical Properties of Iron-Cobalt Alloys for Power Applications IECEC-97, Proceedings of the 32nd Intersociety Energy Conversion Engineering Conference, vol. 1, Aerospace Power Systems and Technologies, Jul. 27-Aug. 1, 1997, Honolulu, Hawaii, pp. 563-568.

(Continued)

*Primary Examiner*—Harry D Wilkins, III
(74) *Attorney, Agent, or Firm*—Buchanan Ingersoll & Rooney PC

(57) ABSTRACT

A high strength and creep resistant soft magnetic Fe—Co alloy includes, in weight %, Fe and Co such that the difference between the Fe and Co is at least 2%, at least 35% Co, and 2.5%≦(V+Mo+Nb), wherein 0.4%≦Mo and/or 0.4%≦Nb. This alloy can further include B, C, W, Ni, Ti, Cr, Mn and/or Al. A vanadium-free high strength soft magnetic Fe—Co alloy includes in weight %, Fe and Co such that the difference between the Fe and Co is at least 2%, and at least 15% Co, the alloy further satisfying (0.1%≦Nb and 0.1%≦W) or 0.25%≦Mn. This alloy can further include B, C, Ni, Ti, Cr and/or Al.

14 Claims, 24 Drawing Sheets

OTHER PUBLICATIONS

Kawahara, Kohji et al., "Effect of Additive Elements on Cold Workability in FeCo Alloys", Journal of Materials Science 18, 1993, pp. 1709-1718.
Kawahara, Kohji et al., "A Possibility for Developing High Strength Soft Magnetic Materials in FeCo-X Alloys", Journal of Materials Science 1984, pp. 2575-2581.
Robert A. Horton, Investment Casting, ASM Handbook, Ninth Edition, entitled "Casting", vol. 15, 1988, pp. 253-269.
G.D. Lahosti, Forming & Forging, ASM Handbook, Ninth Edition, vol. 14, 1988, pp. 59-212.
B. Lynn Ferguson, Powder Shaping and Consolidation Technology, ASM Handbook Ninth Edition, Powder Metal Technologies and Applications, vol. 7, 1988, pp. 311-642.
Written Opinion dated Nov. 27, 2002 for PCT/US01/48563.
Supplemental European Search Report for 01996252 1-2122-US 0148563 dated Mar. 26, 2004.

* cited by examiner

HIGH-STRENGTH HIGH-TEMPERATURE CREEP-RESISTANT IRON-COBALT ALLOYS FOR SOFT MAGNETIC APPLICATIONS

This application is a continuation application of U.S. application Ser. No. 10/314,993 entitled HIGH-STRENGTH HIGH-TEMPERATURE CREEP-RESISTANT IRON-COBALT ALLOYS FOR SOFT MAGNETIC APPLICATIONS, filed on Dec. 10, 2002, now U.S. Pat. No. 6,946,097 which is a continuation-in-part of Ser. No. 09/757,625, filed on Jan. 11, 2001 (U.S. Pat. No. 6,685,882, issued on Feb. 3, 2004), the entire contents of which are hereby incorporated by reference.

RELATED APPLICATION

This application is a continuation-in-part of co-pending U.S. application Ser. No. 09/757,625, filed on Jan. 11, 2001.

FIELD OF THE INVENTION

This invention relates to high-temperature, high-strength magnetic alloys with high saturation magnetization useful for applications such as rotors, stators and/or magnetic bearings of an auxiliary power unit of an aircraft jet engine.

BACKGROUND OF THE INVENTION

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

As disclosed in related U.S. application Ser. No. 09/757,625, the disclosure of which is incorporated herein by reference, binary iron-cobalt (Fe—Co) alloys containing 33-55 wt. % cobalt (Co) are extremely brittle due to the formation of an ordered superlattice at temperatures below 730° C. The addition of about 2 wt. % vanadium (V) inhibits this transformation to the ordered structure and permits the alloy to be cold-worked after quenching from about 730° C. The addition of V also benefits the alloy in that it increases the resistivity, thereby reducing the eddy current losses.

Fe—Co—V alloys have generally been accepted as the best commercially available material for applications requiring high magnetic induction at moderately high fields. Vanadium added to 2 wt. % has been found not to cause a significant drop in saturation magnetization and yet still inhibits the ordering reaction to such an extent that cold working is possible.

Conventional Fe—Co—V alloys employing less than 2% by weight vanadium, however, have undesirable inherent properties. For example, when the magnetic material undergoes a large magnetic loss the energy efficiency of the magnetic material deteriorates significantly. In addition, conventional Fe—Co—V alloys exhibit certain unsuitable magnetic properties when subjected to rapid current fluctuations. Further, as the percentage of vanadium exceeds 2 wt. %, the DC magnetic properties of the material deteriorate.

The composition of conventional Fe—Co—V soft magnetic alloys exhibits a balance between favorable magnetic properties, strength, and resistivity as compared to magnetic pure iron or magnetic silicon steel. These types of alloys are commonly employed in devices where magnetic materials having high saturation magnetic flux density are required.

Fe—Co—V alloys have been used in a variety of applications where a high saturation magnetization is required, i.e., as a lamination material for electrical generators used in aircraft and pole tips for high field magnets. Such devices commonly include soft magnetic material having a chemical composition of about 48-52% by weight Co, less than about 2% by weight vanadium, incidental impurities, and the remainder Fe.

U.S. Pat. No. 4,933,026 to Rawlings et al. discloses soft magnetic cobalt-iron alloys containing V and Nb. The alloys include, in wt. %, 34-51% Co, 0.1-2% Nb, 1.9% V, 0.2-0.3% Ta, or 0.2% Ta+2.1% V. Rawlings et al. also mention previously known magnetic alloys containing 45-55% Fe, 45-55% Co and 1.5-2.5% V. The objective of the alloy of Rawlings et al. is to obtain high saturization magnetization combined with high ductility. The ductility and magnetization of the alloy of Rawlings et al. is attributed to the addition of niobium (Nb). Additionally, Rawlings et al. mentions the use of such an alloy in applications such as pole tips and aerospace applications.

U.S. Pat. No. 5,252,940 to Tanaka discloses an Fe—Co—V alloy having a 1:1 ratio of Fe to Co by weight and containing 2.1-5 wt. % V. The Fe—Co—V composition of Tanaka provides high energy efficiency under fluctuating DC conditions by reducing eddy currents.

Fe—Co—V alloys are also disclosed in U.S. Pat. Nos. 3,634,072; 3,891,475; 3,977,919; 4,116,727; 5,024,542; 5,067,993; 5,252,940; 5,443,787; 5,501,747; 5,741,374; 5,817,191; 6,146,474 and 6,225,556 the disclosures of which, as they are related to thermomechanical processing of such alloys, are hereby incorporated by reference.

According to an article by Phillip G. Colegrove entitled "Integrated Power Unit for a More Electric Airplane", AIAA/AHS/ASEE Aerospace Design Conference, Feb. 16, 1993, Irvine, Calif., an integrated power unit provides electric power for main engine starting and for in-flight emergency power as well as for normal auxiliary power functions. Such units output electric power from a switched-reluctance starter-generator driven by a shaft supported by magnetic bearings. The starter-generator is exposed to harsh conditions and environment in which it must function, e.g., rotational speeds of 50,000 to 70,000 rpm and a continuous operating temperature of approximately 500° C. The machine rotor and stator can be composed of stacks of laminations, each of which is approximately 0.006 to 0.008 inches thick. The rotor stack can be approximately 5 inches in length with a diameter of approximately 4.5 inches and the stator outside diameter can be about 9 inches. HiSat-50, an alloy produced by Telcon Metal Limited of England, has been proposed for the rotor and stator laminations annealed at a temperature providing a desirable combination of strength and magnetic properties. The magnetic bearings are operated through attraction of the shaft toward the magnetic force generator. The bearings exhibit a desirable combination of stiffness and load capability as well as compatibility with requisite operating temperatures and operational frequencies. The operational temperature of the bearings, for example, can be on the order of 650° F.

Iron-cobalt alloys have been proposed for magnetic bearings used in integrated power units and internal starter/generators for main propulsion engines according to an article by Richard T. Fingers et al. entitled "Mechanical Properties of Iron-Cobalt Alloys for Power Applications" published in the 32$^{nd}$ Intersociety Energy Conversion Engineering Conference Proceedings, Vol. 1, p. 563 (1997). Two iron-cobalt alloys investigated include Hipercoh alloy 50HS from Carpenter Technology-Corporation and HiSat-50 from Telcon Metal Limited. After heat treating at 1300 to 1350° F. for 1 to 2 hours, tensile properties were evaluated for specimens prepared from rolled sheet 0.006 inches thick. Both materials are categorized as near 50-50 iron-cobalt alloys having a B2-ordered microstructuire but with small percentages of vanadium to increase ductility, and other additions for grain refinement. The Hiperco™ alloy 50HS is reported to include, in weight percent, 48.75% Co, 1.90% V, 0.30% Nb, 0.05% Mn, 0.05% Si, 0.01% C, balance Fe; whereas HiSat-50 includes 49.5% Co, 0.27% V, 0.45% Ta, 0.04% Mn, 0.08% Si, balance Fe. The alloys annealed at 1300° F. are reported to exhibit the highest strength while those annealed at 1350° F. exhibit the lowest strength. According to the article, in developing motors, generators and magnetic bearings, it will be necessary to take into consideration mechanical behavior, electrical loss and magnetic properties under conditions of actual use. For rotor applications these conditions are temperatures above 1000° F. and exposure to alternating magnetic fields of 2 Tesla at frequencies of 5000 Hz. Furthermore, the clamping of the rotor will result in large compressive axial loads while rotation of the rotor can create tensile hoop stresses of approximately 85 ksi. Because eddy current losses are inversely proportional to resistivity, the greater the resistivity, the lower the eddy current losses and heat generated. Resistivity data documented for 50HS annealed for 1 hour at temperatures of 1300 to 1350° F. indicate a mean room temperature resistivity of about 43 micro-ohm-cm whereas a value of 13.4 micro-ohm-cm is reported for HiSat-50 annealed for 2 hours at temperatures of 1300 to 1350° F. The article concludes that both alloys appear to be good candidates for machine designs requiring relatively high strength and good magnetic and electrical performance.

Conventional Fe—Co—V based soft magnetic alloys are used widely where high saturation magnetization values are important. However, their yield strengths are low at room temperature, and the yield strengths are even lower at high temperatures, making the alloys unsuitable for applications such as magnetic parts for jet engines that impose high temperatures and centrifugal stress on materials. Accordingly, there is a need for low cost alloys having improved strength (both at room temperature and elevated temperatures), improved creep resistance, and increased resistivity that retain good magnetic properties.

SUMMARY OF THE INVENTION

The invention provides a soft magnetic Fe—Co alloy comprising, in weight % Fe and Co such that the difference between the Fe and Co is at least 2%, at least 35% Co, and $2.5 \leqq (V+Mo+Nb)$, wherein $0.4 \leqq Mo$ and/or $0.4 \leqq Nb$. The alloy can comprise up to 8% V, preferably 1.5 to 8% V and more preferably at least 3% V. The alloy can further comprise 0.001 to 0.02% B; 0.01 to 0.1% C; 0.4 to 3% Mo; 0.4 to 2% Nb; 1 to 5% W; 0.5 to 2% Ni; 0.3 to 2% Ti; 1 to 2% Cr; 0.25 to 3% Mn and/or 0.5 to 1.5% Al. A preferred alloy includes 0.4 to 3% Mo and/or 0.4 to 2% Nb. According to a preferred embodiment, the alloy can comprise 35 to 51% Co; 0 to 8% V; 0.001 to 0.02% B; 0 to 0.1% C; 0.4 to 3% Mo; 0.4 to 2% Nb; 1 to 5% W; 1 to 2% Ni; 0.3 to 2% Ti; 1 to 2 wt. % Cr; 0.25 to 3 wt. % Mn and/or 0.5 to 1.5% Al, and the balance Fe.

At room temperature, the alloy can exhibit an ultimate tensile strength of at least 800 MPa, a yield strength of at least 600 MPa, a total elongation of at least 3.5% and/or a saturization magnetization of at least 190 emu/g. At 600° C., the alloy can exhibit a yield strength of at least 500 MPa, a rupture life under a stress of at least 500 MPa of at least 24 hours and/or a total elongation of at least 7.5%. According to a preferred embodiment, the alloy can exhibit a creep resistance at 600° C. under a stress of at least 500 MPa of at least $6\times10^{-7}$/sec or better, a weight gain of 1.5 mg/cm$^2$ or less when exposed to air for 100 hours at 600° C. and/or an electrical resistivity at 600° C. of at least 55 μohm-cm, preferably at least 80 μohm-cm.

The invention also provides a vanadium-free high strength soft magnetic Fe—Co alloy comprising, in weight %, Fe and Co such that the difference between the Fe and Co is at least 2%, and at least 15% Co, the alloy further satisfying the inequality ($0.1\% \leqq Nb$ and $0.1\% \leqq W$) and/or the inequality $0.25\% \leqq Mn$.

According to one embodiment, the alloy can exhibit a room temperature ultimate tensile strength of at least 800 MPa, a room temperature yield strength of at least 600 MPa, a yield strength at 600° C. of at least 500 MPa and/or a total elongation at room temperature of at least 3.5%. According to a further embodiment, the alloy can exhibit a total elongation at 600° C. of at least 7.5%, room temperature saturization magnetization of at least 190 emu/g, creep resistance at 600° C. under a stress of at least 500 MPa of at least $6\times10^{-7}$/sec or better, weight gain of 1.5 mg/cm$^2$ or less when exposed to air for 100 hours at 600° C. and/or electrical resistivity at 600° C. of at least 80 μohm-cm.

The invention also provides a method of manufacturing a high strength soft magnetic Fe—Co alloy. A sheet of the alloy can be prepared by casting, forging, hot rolling, cold rolling and age hardening. A sheet can be prepared by forming the alloy into powder, mixing the powder with a binder, forming the powder mixture into a sheet, heating the sheet to remove the binder and sintering the alloy powder, cold rolling the sintered sheet, and heat treating the rolled sheet. According to a further embodiment, a sheet can be prepared by forming the alloy into powder, plasma spraying the powder into a sheet, cold rolling the sheet and the heat treating the cold rolled sheet. According to yet a further embodiment, a sheet can be prepared by forming the alloy into powder, mechanically alloying the powder with oxide particles, forming the mechanically alloyed powder into a sheet, cold rolling the sheet, and age hardening the cold rolled sheet. The alloy preferably has an oxide dispersoid content of 0.5 to 4 wt. % and/or an average grain size of 1 to 30μm.

Alloys can be formed into sheets having an insulating coating thereon, the insulating coating having a thickness of 1 to 10 microns, and overlapping the coated sheets to form a laminated article such as a stator or rotor of a starter/generator for an aircraft jet engine. According to a preferred embodiment, the method comprises forming the alloy into a magnetic bearing by casting the alloy or sintering powders of the alloy. According to a yet further preferred embodiment, the method comprises forming the alloy into a part of a high performance transformer, a laminated part of an electrical generator, a pole tip of a high field magnet, a magnetically driven actuator of a device such as an impact printer, a diaphragm of a telephone handset, a solenoid valve of an armature-yoke system of a diesel injection engine, a magnetostrictive transducer, an electromagnetically controlled intake or exhaust nozzle, a flux guiding part of an inductive speed counter of an anti-lock brake system, a magnetic lens, a solenoid core of a magnetic switch or part of a magnetically excited circuit.

The alloy can be strengthened through solid solution hardening and/or precipitation strengthening. The alloy can be hot worked at a temperature of at least 900° C., annealed in the temperature range of 900° C. to 1100° C. for 10 min., quenched in an ice brine solution, and then cold rolled at room temperature. According to a preferred method, the alloy is cast at an oxygen partial pressure less than 0.005%. According to yet another preferred method, the alloy is prepared as a sheet and the sheet is rolled to a thickness of 5 to 100 mils.

A further method comprises preparing a sheet, hot rolling the sheet to a thickness of about 0.11 inches at a temperature of 950° C., quenching the sheet from 950° C., and then cold rolling the sheet to a thickness in the range of 0.002 to 0.03 inches. A still further method comprises preparing a sheet, hot rolling the sheet to a thickness of about 0.16 inches at a temperature of 950° C., and then cold rolling the sheet to a thickness of about 0.03 inches.

The sheet can be intermediate annealed at a temperature of about 950° C. during cold rolling.

A preferred method comprises preparing a sheet, hot forging the sheet to a thickness of at least about 0.25 inches at a temperature of about 1100° C., hot rolling the sheet to a thickness of about 0.08 inches at a temperature of about 1100° C., and then warm rolling the sheet to a thickness of about 0.03 inches at a temperature of about 900° C. A still further preferred method comprises preparing a sheet, hot forging the sheet to a thickness of about 0.25 inches at a temperature of about 1100° C., hot rolling the sheet to a thickness of about 0.08 inches at a temperature of about 1100° C., annealing the sheet for about 10 min. in the temperature range of 900 to 1100° C., quenching the sheet in an ice brine quench, and then cold rolling the sheet to a thickness of about 0.03 inches. Another preferred method comprises preparing a sheet, hot forging the sheet to a thickness of about 0.5 inches at a temperature of about 1000° C., hot rolling the sheet to a thickness of about 0.25 inches at a temperature of about 950° C., hot rolling the sheet to a thickness of about 0.08 inches at a temperature of about 1100° C., quenching the sheet from a temperature of from 900 to 1000° C., and then cold rolling the sheet to a thickness of about 0.03 inches.

A preferred method comprises forging or rolling the alloy at a temperature greater than 1000° C. in order to break down the cast microstructure. Another method comprises cold rolling the alloy, and then annealing the alloy at a temperature in the range of 850 to 1000° C.; water quenching the alloy; and aging the alloy at a temperature in the range of 600 to 700° C., wherein the method is effective in achieving a room temperature yield stress of at least 800 MPa and a room temperature ultimate tensile strength of at least 1000 MPa.

BRIEF DESCRIPTION OF THE DRAWINGS

The following detailed description of preferred embodiments makes reference to the accompanying drawings in which like numerals designate like elements and in which:

FIGS. 7 and 8*a-b* show hardness values for alloys solutionized at 1100° C. for 10 minutes, quenched in iced brine and aged at 600° C. wherein FIG. 7 shows the variation of hardness with aging time and FIGS. 8*a*-8*b* show the maximum Vicker's hardness achieved.

DETAILED DESCRIPTION OF PREFERRED EMBODIMENTS

Figure 1:
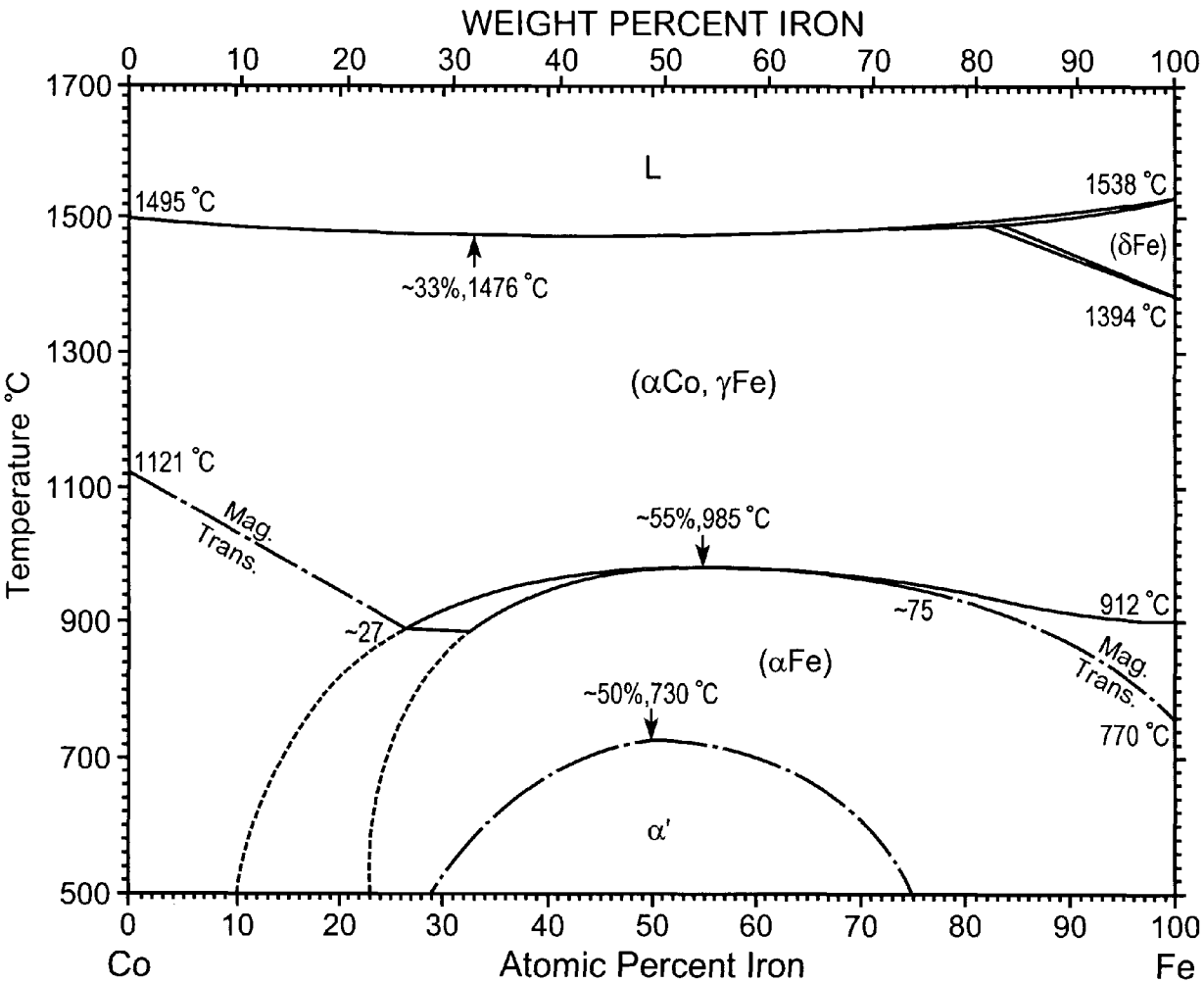
FIG. 1 is an Fe—Co equilibrium diagram indicating the composition range and ordering temperature of ordered Fe—Co alloys.

The invention provides Fe—Co and Fe—Co—V alloys having mechanical and magnetic properties suitable for a number of advanced applications. For example, the tensile and creep strengths at both room temperature and elevated temperature, as well as the high resistivity of the alloys, make them more suitable than conventional soft magnetic alloys for advanced aerospace applications.

Table 1a provides exemplary compositions in weight percent (and Table 1b provides the compositions in atomic percent) of soft magnetic iron-cobalt (Fe—Co) alloys. For all of the alloys represented in Table 1, iron represents the balance of the composition. SM-1 is analogous to prior art iron-cobalt-vanadium (Fe—Co—V) alloys currently in commercial production whereas samples SM-1a through SM-29 are inventive alloys. There are several general groupings of the alloys based on composition. The first grouping is a cobalt based alloy: SM-2 is an example of such a cobalt based alloy. A second grouping is an alloy where neither iron nor cobalt represent larger than 50 wt. % of the composition: SM-3 is representative of this group. The third grouping is an iron based alloy: SM-4 through SM-13 represent this grouping. SM-14 through SM-16 represent alloys where the atomic percent Fe is equal to the atomic percent Co, and the atomic percent of V is 2 at. % or less. These alloys also contain alloying additions of B, Mo, Nb, W, Ni and/or Cr. In SM-17 through SM-20, the atomic percent of Co is 35 at. % and the atomic percent of V is 2 at. %. These alloys also contain alloying additions of B, C, Mo, Nb, W, Ni, Ti, Cr, Mn and/or Al. In SM-21 through 23, the atomic percent of Co is 15 at. % and the alloys do not contain vanadium. SM-24 through SM-28 also represent alloys where the atomic percent Fe is equal to the atomic percent Co with 3.5 at. % V, 0.5 at. % each of Mo and Nb, and alloying additions of B, C, W and/or Ni. Finally, SM-29 is a 2 at. % V alloy with B, C, Mo, Nb and W additions.

According to one embodiment, an Fe—Co alloy comprise Fe and Co such that the difference between the Fe and Co is at least 2%, at least 35% Co, and $2.5 \leqq (V+Mo+Nb)$, wherein $0.4 \leqq Mo$ and/or $0.4 \leqq Nb$. The alloy may contain at least 1.5 wt. % vanadium and preferably at least 3 wt. % V.

Thus, the main constituents of the Fe—Co composition are iron and cobalt preferably with additions of V, Mo and/or Nb. The remaining compositional variations can be classified under three levels of vanadium: less than 1.5 wt. %; greater than or equal to 1.5 wt. %; and greater than 3 wt. % V.

In comparison with the prior art SM-1 sample, characteristic properties of SM-2 will demonstrate the impact of increased vanadium content. Similarly, the characterization of samples SM-3 through SM-29 are designed to evaluate the impact of various alloying constituents on the properties of the alloy. In broad terms, the variations between compositions includes increasing the vanadium content to about 8 wt. % and adding boron (B), carbon (C), molybdenum (Mo), niobium (Nb), tungsten (W), nickel (Ni), titanium (Ti), chromium (Cr), manganese (Mn), and aluminum (Al) in varying combinations.

TABLE 1a

| | Composition (wt. %) | | | | | | | | | | | |
|---|---|---|---|---|---|---|---|---|---|---|---|---|
| Sample | Co | V | B | C | Mo | Nb | W | Ni | Ti | Cr | Mn | Al |
| SM-1 (prior art) | 50.43 | 1.78 | — | — | — | — | — | — | — | — | — | — |
| SM-1a | 50.11 | 1.95 | 0.01 | — | 0.83 | 0.81 | — | — | — | — | — | — |
| SM-1b | 49.57 | 1.92 | 0.01 | — | 0.82 | 0.80 | 1.58 | — | — | — | — | — |
| SM-1c | 49.55 | 1.92 | 0.01 | — | 0.82 | 0.80 | 1.58 | 1.01 | — | — | — | — |
| SM-1d | 49.03 | 1.90 | 0.01 | — | 0.81 | 0.79 | 3.12 | — | — | — | — | — |
| SM-1e | 49.59 | 1.92 | 0.01 | 0.01 | 0.82 | 0.80 | 1.58 | — | — | — | — | — |
| SM-2 | 50.56 | 4.46 | — | — | — | — | — | — | — | — | — | — |
| SM-2a | 49.66 | 4.38 | 0.01 | 0.00 | 0.83 | 0.80 | 1.58 | 1.01 | — | — | — | — |
| SM-3 | 46.53 | 4.47 | — | — | — | — | — | — | — | — | — | — |
| SM-4 | 41.48 | 4.48 | — | — | — | — | — | — | — | — | — | — |
| SM-4a | 40.74 | 4.40 | 0.01 | 0.00 | 0.83 | 0.80 | 1.59 | 1.01 | — | — | — | — |
| SM-4b | 40.78 | 4.41 | 0.01 | 0.03 | 0.83 | 0.80 | 1.59 | 1.02 | — | — | — | — |
| SM-5 | 35.98 | 7.77 | — | — | — | — | — | — | — | — | — | — |
| SM-5a | 35.74 | 4.41 | 0.01 | — | 0.83 | 0.80 | 1.59 | 1.02 | — | — | — | — |
| SM-5b | 35.35 | 4.36 | 0.01 | — | 0.82 | 0.80 | 3.15 | 1.01 | — | — | — | — |
| SM-5c | 35.70 | 1.94 | 0.01 | 0.03 | 0.83 | 0.80 | 1.59 | 1.02 | — | — | — | — |
| SM-6 | 41.48 | 4.48 | 0.001 | — | — | — | — | — | — | — | — | — |
| SM-7 | 41.53 | 4.49 | 0.001 | 0.03 | — | — | — | — | — | — | — | — |
| SM-8 | 41.38 | 4.47 | 0.001 | 0.03 | 0.84 | — | — | — | — | — | — | — |
| SM-9 | 41.25 | 4.45 | 0.001 | 0.03 | 0.84 | 0.81 | — | — | — | — | — | — |
| SM-10 | 41.28 | 4.46 | 0.001 | 0.03 | 0.84 | 0.81 | — | — | 0.42 | — | — | — |
| SM-10a | 40.83 | 4.41 | 0.01 | 0.03 | 0.83 | 0.80 | 1.59 | — | 0.41 | — | — | — |
| SM-11 | 41.41 | 4.47 | 0.001 | 0.03 | 0.84 | — | — | — | 0.42 | — | — | — |
| SM-12 | 41.42 | 4.47 | 0.001 | 0.03 | — | 0.82 | — | — | 0.42 | — | — | — |
| SM-13 | 36.33 | 7.71 | 0.001 | 0.03 | 0.85 | 0.82 | — | — | 0.42 | — | — | — |
| SM-13a | 35.93 | 7.63 | 0.01 | 0.03 | 0.84 | 0.81 | 1.60 | — | 0.42 | — | — | — |
| SM-13b | 35.91 | 7.63 | 0.01 | 0.03 | 0.84 | 0.81 | 1.60 | — | — | — | — | — |
| SM-13c | 35.87 | 7.62 | 0.01 | — | 0.83 | 0.81 | 1.60 | — | — | — | — | — |
| SM-14 | 48.28 | 1.75 | 0.01 | — | 0.82 | 0.80 | 1.58 | 1.01 | — | — | — | — |
| SM-15 | 48.27 | — | 0.01 | — | 0.82 | 0.80 | 1.58 | 1.01 | — | 1.78 | — | — |
| SM-16 | 49.35 | 1.76 | 0.01 | — | 0.42 | 0.40 | 0.80 | 0.51 | — | — | — | — |
| SM-17 | 36.12 | 1.78 | 0.001 | 0.03 | 0.84 | 0.81 | — | — | 0.42 | — | — | — |
| SM-18 | 35.66 | 1.76 | 0.001 | — | 0.83 | 0.80 | — | — | 1.59 | — | 1.42 | — |
| SM-19 | 35.7 | 1.76 | 0.001 | — | 0.83 | 0.8 | — | — | 1.59 | 1.35 | 1.43 | — |
| SM-20 | 35.96 | 1.78 | 0.001 | — | 0.84 | 0.81 | — | — | 1.6 | 1.36 | — | 0.71 |
| SM-21 | 15.71 | — | — | — | — | — | — | — | — | — | 2.64 | — |
| SM-22 | 15.49 | — | 0.01 | — | — | 0.81 | 1.61 | — | — | — | 2.6 | — |
| SM-23 | 15.56 | — | 0.01 | — | — | 0.82 | 1.62 | — | — | — | — | 0.47 |
| SM-24 | 48.91 | 3.10 | 0.01 | — | 0.83 | 0.81 | — | — | — | — | — | — |
| SM-25 | 48.12 | 3.07 | 0.01 | — | 0.83 | 0.80 | 1.58 | — | — | — | — | — |
| SM-26 | 47.60 | 3.07 | 0.01 | — | 0.82 | 0.80 | 1.58 | 1.01 | — | — | — | — |
| SM-27 | 47.35 | 3.03 | 0.01 | — | 0.82 | 0.79 | 3.13 | — | — | — | — | — |
| SM-28 | 48.11 | 3.07 | 0.01 | 0.01 | 0.83 | 0.80 | 1.58 | — | — | — | — | — |
| SM-29 | 48.79 | 1.75 | 0.01 | 0.01 | 0.82 | 0.80 | 1.58 | — | — | — | — | — |

TABLE 1b

| | Composition (at. %) | | | | | | | | | | | |
|---|---|---|---|---|---|---|---|---|---|---|---|---|
| Sample | Co | V | B | C | Mo | Nb | W | Ni | Ti | Cr | Mn | Al |
| SM-1 (prior art) | 49 | 2 | — | — | — | — | — | — | — | — | — | — |
| SM-1a | 49 | 2.2 | 0.05 | — | 0.5 | 0.5 | — | — | — | — | — | — |
| SM-1b | 49 | 2.2 | 0.05 | — | 0.5 | 0.5 | 0.5 | — | — | — | — | — |
| SM-1c | 49 | 2.2 | 0.05 | — | 0.5 | 0.5 | 0.5 | 1.0 | — | — | — | — |
| SM-1d | 49 | 2.2 | 0.05 | — | 0.5 | 0.5 | 1.0 | — | — | — | — | — |
| SM-1e | 49 | 2.2 | 0.05 | 0.05 | 0.5 | 0.5 | 0.5 | — | — | — | — | — |
| SM-2 | 49 | 5 | — | — | — | — | — | — | — | — | — | — |
| SM-2a | 49 | 5 | 0.05 | — | 0.5 | 0.5 | 0.5 | 1.0 | — | — | — | — |
| SM-3 | 45 | 5 | — | — | — | — | — | — | — | — | — | — |
| SM-4 | 40 | 5 | — | — | — | — | — | — | — | — | — | — |
| SM-4a | 40 | 5 | 0.05 | — | 0.5 | 0.5 | 0.5 | 1.0 | — | — | — | — |
| SM-4b | 40 | 5 | 0.05 | 0.15 | 0.5 | 0.5 | 0.5 | 1.0 | — | — | — | — |
| SM-5 | 35 | 8.6 | — | — | — | — | — | — | — | — | — | — |
| SM-5a | 35 | 5 | 0.05 | — | 0.5 | 0.5 | 0.5 | 1.0 | — | — | — | — |

TABLE 1b-continued

| Sample | Composition (at. %) | | | | | | | | | | | |
|---|---|---|---|---|---|---|---|---|---|---|---|---|
| | Co | V | B | C | Mo | Nb | W | Ni | Ti | Cr | Mn | Al |
| SM-5b | 35 | 5 | 0.05 | — | 0.5 | 0.5 | 1.0 | 1.0 | — | — | — | — |
| SM-5c | 35 | 2.2 | 0.05 | 0.15 | 0.5 | 0.5 | 0.5 | 1.0 | — | — | — | — |
| SM-6 | 40 | 5 | 0.005 | — | — | — | — | — | — | — | — | — |
| SM-7 | 40 | 5 | 0.005 | 0.15 | — | — | — | — | — | — | — | — |
| SM-8 | 40 | 5 | 0.005 | 0.15 | 0.5 | — | — | — | — | — | — | — |
| SM-9 | 40 | 5 | 0.005 | 0.15 | 0.5 | 0.5 | — | — | — | — | — | — |
| SM-10 | 40 | 5 | 0.005 | 0.15 | 0.5 | 0.5 | — | — | 0.5 | — | — | — |
| SM-10a | 40 | 5 | 0.05 | 0.15 | 0.5 | 0.5 | 0.5 | — | 0.5 | — | — | — |
| SM-11 | 40 | 5 | 0.005 | 0.15 | 0.5 | — | — | — | 0.5 | — | — | — |
| SM-12 | 40 | 5 | 0.005 | 0.15 | — | 0.5 | — | — | 0.5 | — | — | — |
| SM-13 | 35 | 8.6 | 0.05 | 0.15 | 0.5 | 0.5 | — | — | 0.5 | — | — | — |
| SM-13a | 35 | 8.6 | 0.05 | 0.15 | 0.5 | 0.5 | 0.5 | — | 0.5 | — | — | — |
| SM-13b | 35 | 8.6 | 0.05 | 0.15 | 0.5 | 0.5 | 0.5 | — | — | — | — | — |
| SM-13c | 35 | 8.6 | 0.05 | — | 0.5 | 0.5 | 0.5 | — | — | — | — | — |
| SM-14 | 47.73 | 2 | 0.05 | — | 0.5 | 0.5 | 0.5 | 1.0 | — | — | — | — |
| SM-15 | 47.73 | — | 0.05 | — | 0.5 | 0.5 | 0.5 | 1.00 | — | 2.0 | — | — |
| SM-16 | 48.35 | 2.0 | 0.05 | — | 0.25 | 0.25 | 0.25 | 0.5 | — | — | — | — |
| SM-17 | 35 | 2.0 | 0.005 | 0.15 | 0.5 | 0.5 | — | — | 0.5 | — | — | — |
| SM-18 | 35 | 2.0 | 0.005 | — | 0.5 | 0.5 | 0.5 | — | — | — | 1.5 | — |
| SM-19 | 35 | 2.0 | 0.005 | — | 0.5 | 0.5 | 0.5 | — | — | 1.5 | 1.5 | — |
| SM-20 | 35 | 2.0 | 0.005 | — | 0.5 | 0.5 | — | — | 0.5 | 1.5 | — | 1.5 |
| SM-21 | 15 | — | — | — | — | — | — | — | — | — | 2.7 | — |
| SM-22 | 15 | — | 0.05 | — | — | 0.5 | 0.5 | — | — | — | 2.7 | — |
| SM-23 | 15 | — | 0.05 | — | — | 0.5 | 0.5 | — | — | — | — | 1.0 |
| SM-24 | 47.73 | 3.5 | 0.05 | — | 0.5 | 0.5 | — | — | — | — | — | — |
| SM-25 | 47.48 | 3.5 | 0.05 | — | 0.5 | 0.5 | 0.5 | — | — | — | — | — |
| SM-26 | 46.98 | 3.5 | 0.05 | — | 0.5 | 0.5 | 0.5 | 1.0 | — | — | — | — |
| SM-27 | 47.23 | 3.5 | 0.05 | — | 0.5 | 0.5 | 1.0 | — | — | — | — | — |
| SM-28 | 47.45 | 3.5 | 0.05 | 0.05 | 0.5 | 0.5 | 0.5 | — | — | — | — | — |
| SM-29 | 47.95 | 2.0 | 0.05 | 0.05 | 0.5 | 0.5 | 0.5 | — | — | — | — | — |

Figure 2A:
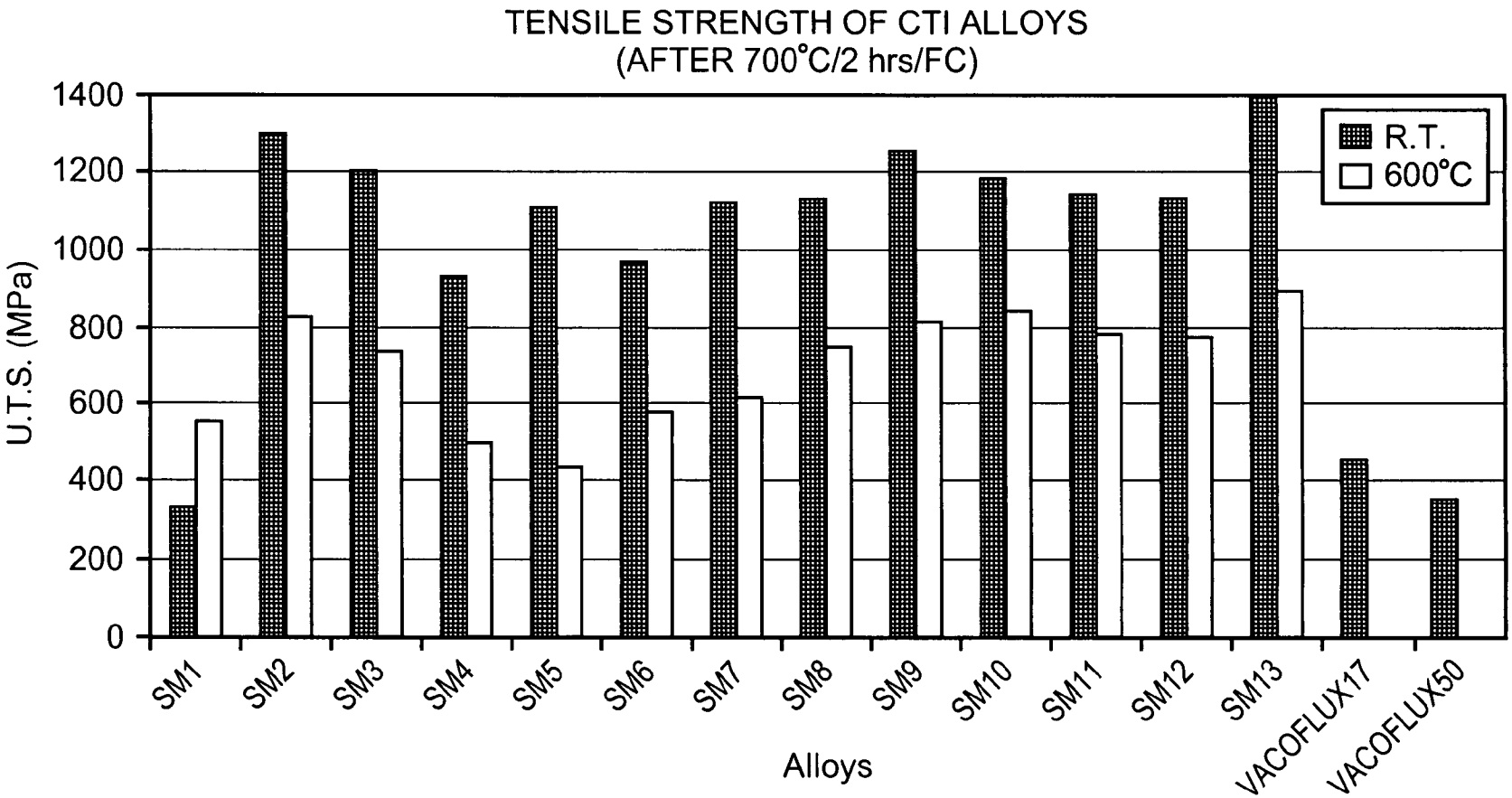
FIGS. 2*a*-2*b* show tensile strength at room temperature and at 600° C. for various alloys.
Figure 2B:
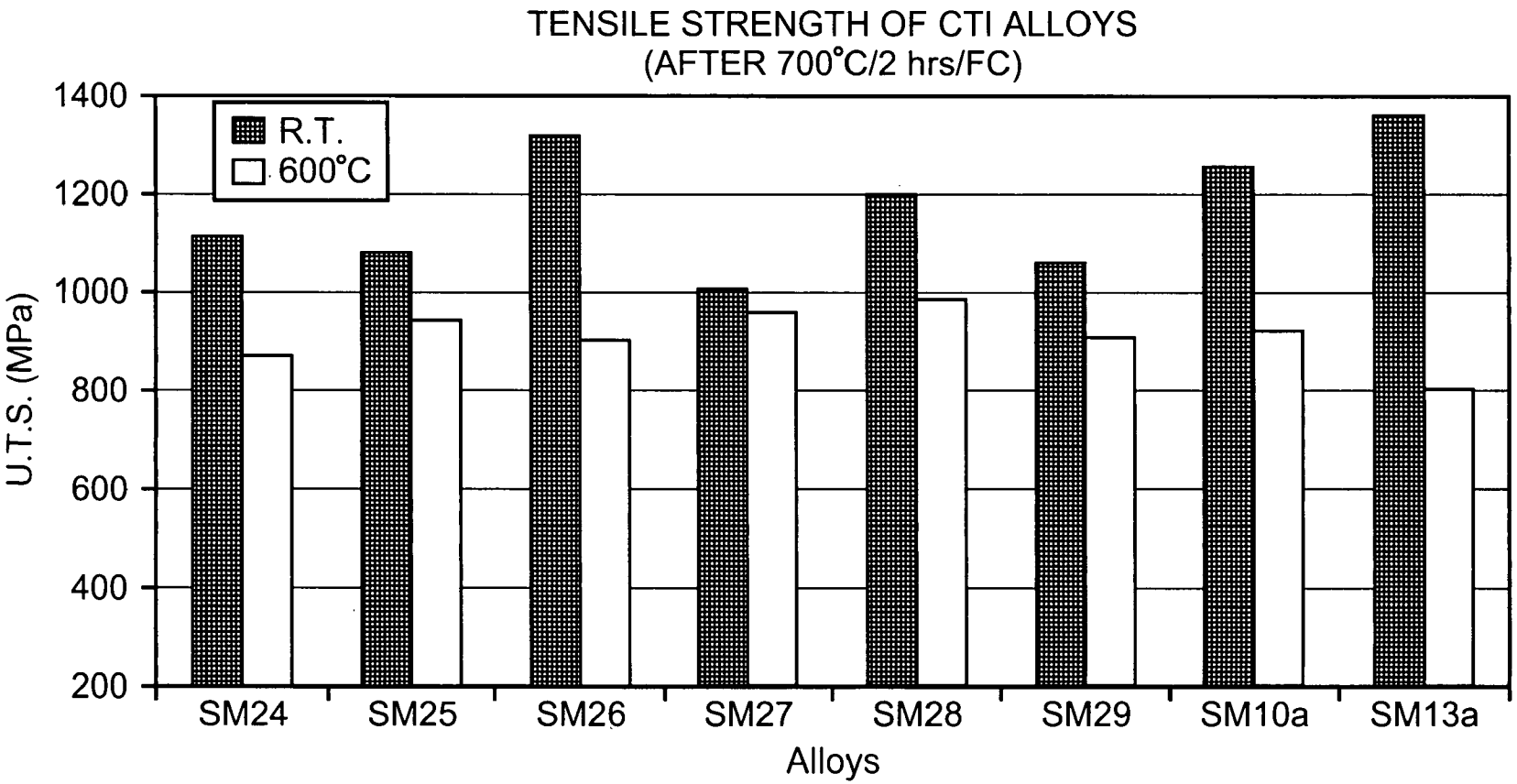

FIGS. 2*a*-2*b* show tensile strength at room temperature for alloys SM-2 through SM-13. Prior art alloy SM-1 and prior art alloys Vacoflux-17 and Vacoflux-50 are also included. These last two prior art samples are commercial products available from Vacuumschmelze GbmH of Germany. The tensile strength in MPa for prior art commercially available Fe—Co—V alloys is typically in the range of from 350-450 MPa. In contrast, SM-2 through SM-13 show a tensile strength of at least 800 MPa, preferably at least 1000 MPa. SM-2, SM-3, SM-9, SM-10a, SM-13b, and SM-26, for example, display a tensile strength of greater than 1200 MPa. Each of these samples has an increased vanadium content and/or an increased (Mo+Nb) content compared with prior art sample SM-1 and the other prior art samples. SM-2 represents a Co-based alloy and the very large increase in tensile strength exhibited by SM-2 may be attributed to the increased vanadium content.

The Fe and Co contents of SM-3 are less than 50 wt. %. As in sample SM-2, the vanadium content is greater than 4 wt. %. From FIG. 2*a*, it can be seen that the tensile strength of SM-2 and SM-3 are comparable, both being approximately 1200 MPa. Therefore, one can conclude that the tensile strengths depicted by SM-2 and SM-3 are more strongly associated with the increased vanadium content than in small variations between the iron and cobalt.

SM-4 and SM-5 are iron-based samples in which the vanadium content is varied between 4 and 8 wt. %, with the balance of the composition being cobalt. The tensile strengths for SM-4 and SM-5 are in the range of 850 to 1100 MPa which is higher than that exhibited by the prior art samples. This may be attributed to the increased vanadium content. Even between the two alloys SM-4 and SM-5, an increase in vanadium from about 4.5 to about 7.8 wt. % corresponds to an increase in the tensile strength and supports the conclusion of the beneficial strengthening effect of the vanadium.

SM-6 to SM-13 and SM-24 through SM-29 exhibit tensile strength approximately double that of the prior art samples. SM-13 shows an increase in vanadium content correlates to an increase in tensile strength. SM-26 shows that inclusion of nickel also correlates to an increase in tensile strength.

Figure 3A:
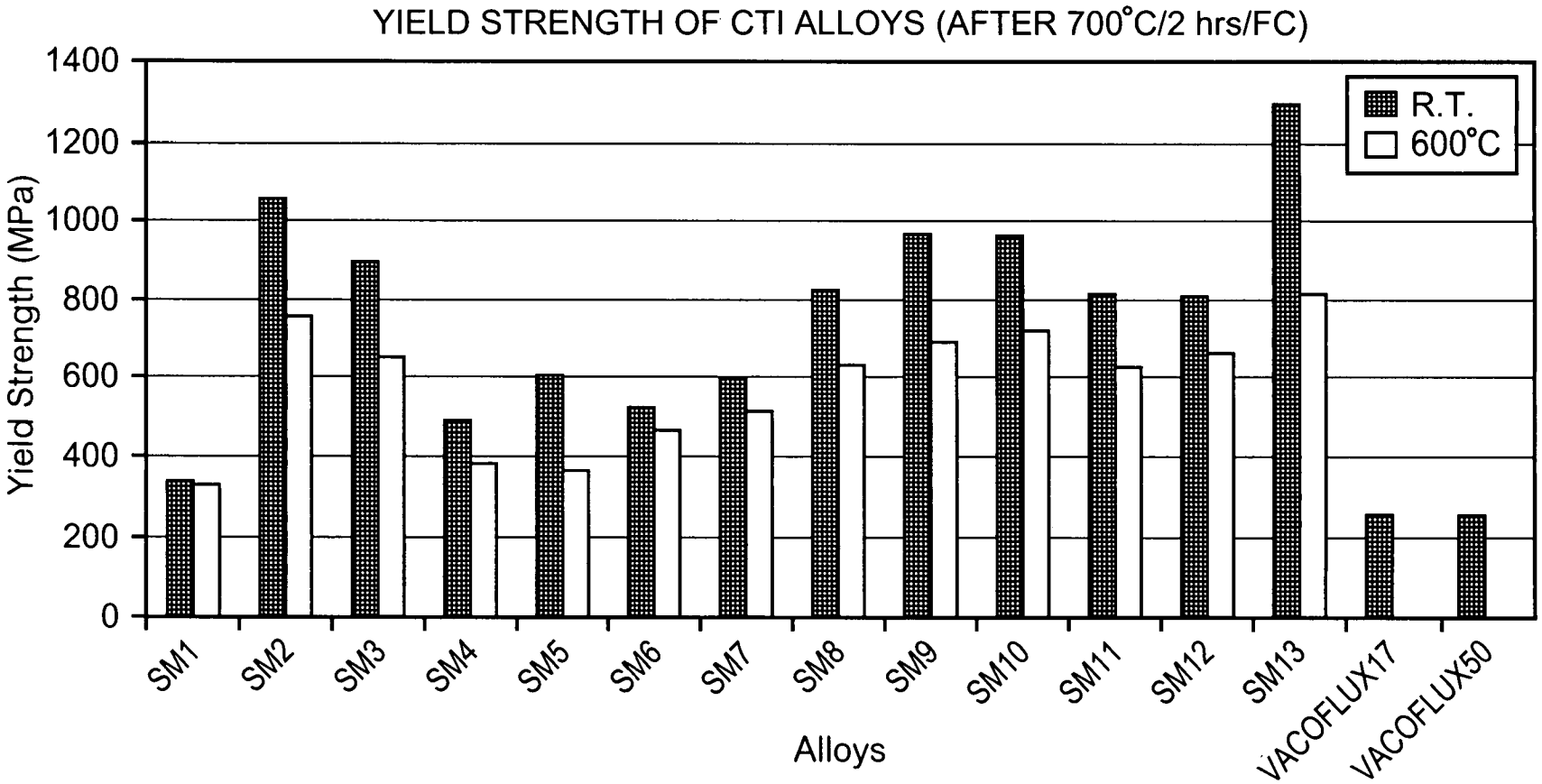
FIGS. 3*a*-3*b* show yield strength at room temperature and at 600° C. for various alloys.
Figure 3B:
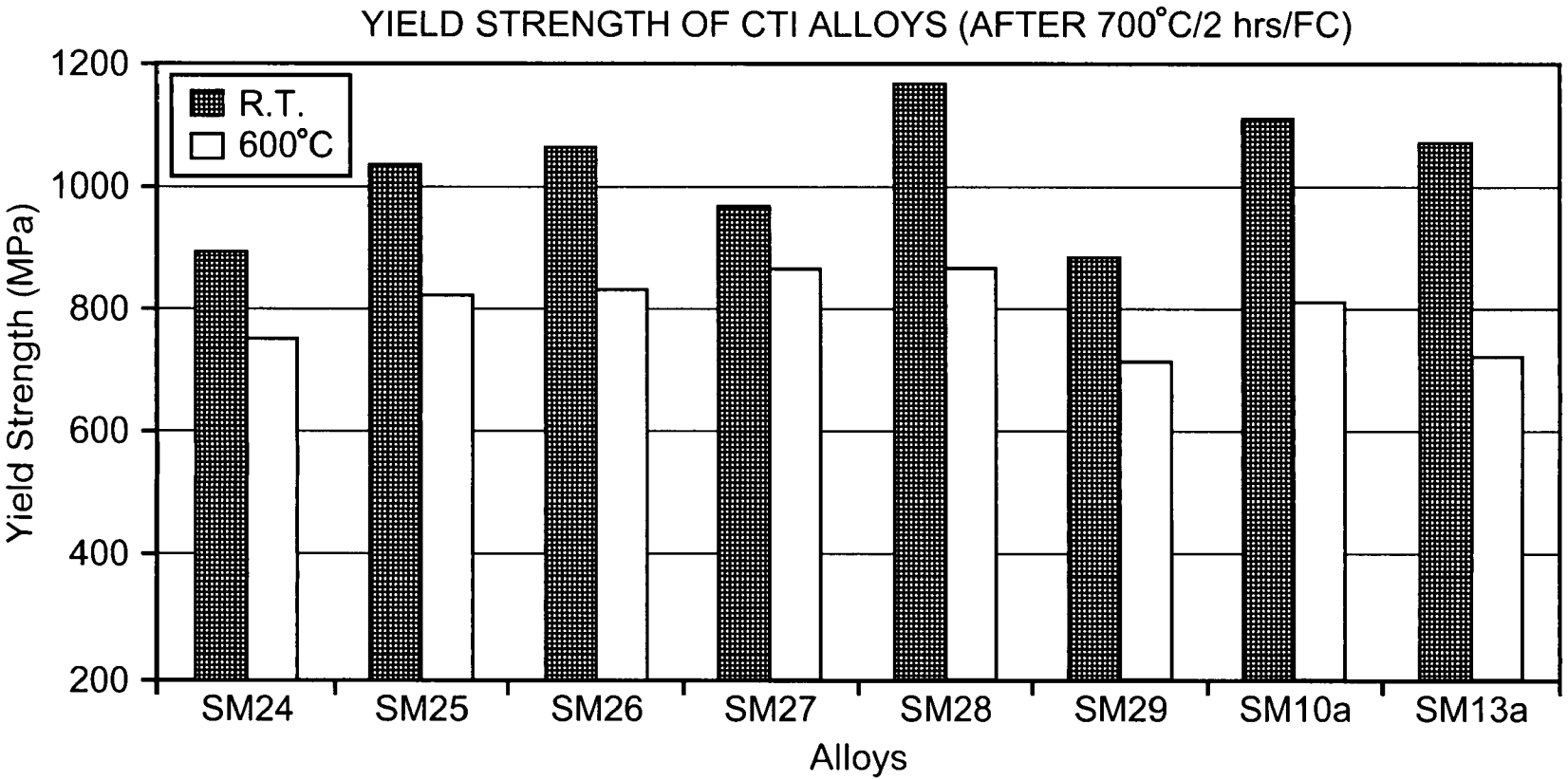

FIGS. 3*a*-3*b* show yield strength at room temperature for SM-2 through SM-13 and SM-24 through SM-29 relative to the comparative sample and the Vacoflux alloys. In general, prior art Fe—Co—V alloys may be characterized by yield strengths of 250-350 MPa. In contrast, at room temperature, the samples SM-2 through SM-13 and SM-24 through SM-29 display a minimum yield strength of about 500 MPa, preferred yield strengths above 600 MPa, and more preferred yield strengths of above 1000 MPa. The highest room temperature yield strength was found for sample SM-13 and was greater than 1,200 MPa. At 600° C., these alloys display a minimum yield strength of about 400 MPa, preferred yield strengths above 600 MPa, and more preferred yield strengths of above 700 MPa. The highest yield strength at 600° C. was found for sample SM-28 and was greater than about 850 MPa.

The trends in yield strength are similar to the trends observed for tensile strength. For most of the cobalt-based Fe—Co—V alloys in which the vanadium content is increased to greater than 4 wt. %, a yield strength of over 700 MPa has been attained. This implies that the increase in vanadium correlates with an increase in yield strength. Likewise, for sample SM-3 the yield strength is comparable to SM-2. This indicates that increased vanadium content provides higher yield strengths independent of variations in the base materials. For iron-based Fe—Co—V alloys, samples SM-4 and SM-5 exhibit a yield strength at room temperature and 600° C. between 400-600 MPa. The increase in vanadium content from 4.5 to 7.5 wt. % (e.g., sample SM-5) corresponds to an increase in yield strength.

Samples SM-6 through SM-13 and SM-24 through SM-29 are alloys with varying compositional constituents. All have a room temperature yield strength above 500 MPa, and preferably above 800 MPa. For SM-13, in which the vanadium content is about 8 at %, the yield strength is unexpectedly increased to 1,300 MPa. Samples SM-24 through SM-29 are alloys where the atomic percent of Fe is approximately equal to the atomic percent of Co, and the alloys contain both Mo and Nb such that, in weight percent, $0.25 \leqq (Mo+Nb) \leqq 5.0$. With the exception of SM-29, these alloys also contain greater than 3 wt. % vanadium. All of these samples have a room temperature yield strength above 800 MPa. Sample SM-28, which has a yield strength in excess of 1100 MPa, also comprises, in weight. %, 3.07% V, 0.01% B, 0.01% C, 0.83% Mo, 0.80% Nb and 1.58% W. In contrast, sample SM-29, which is compositionally equivalent to SM-28 except that it comprises only 1.75% V, has a yield strength of less than 900 MPa. This further supports the correlation between an increase in vanadium content and an increase in yield strength.

Figure 4A:
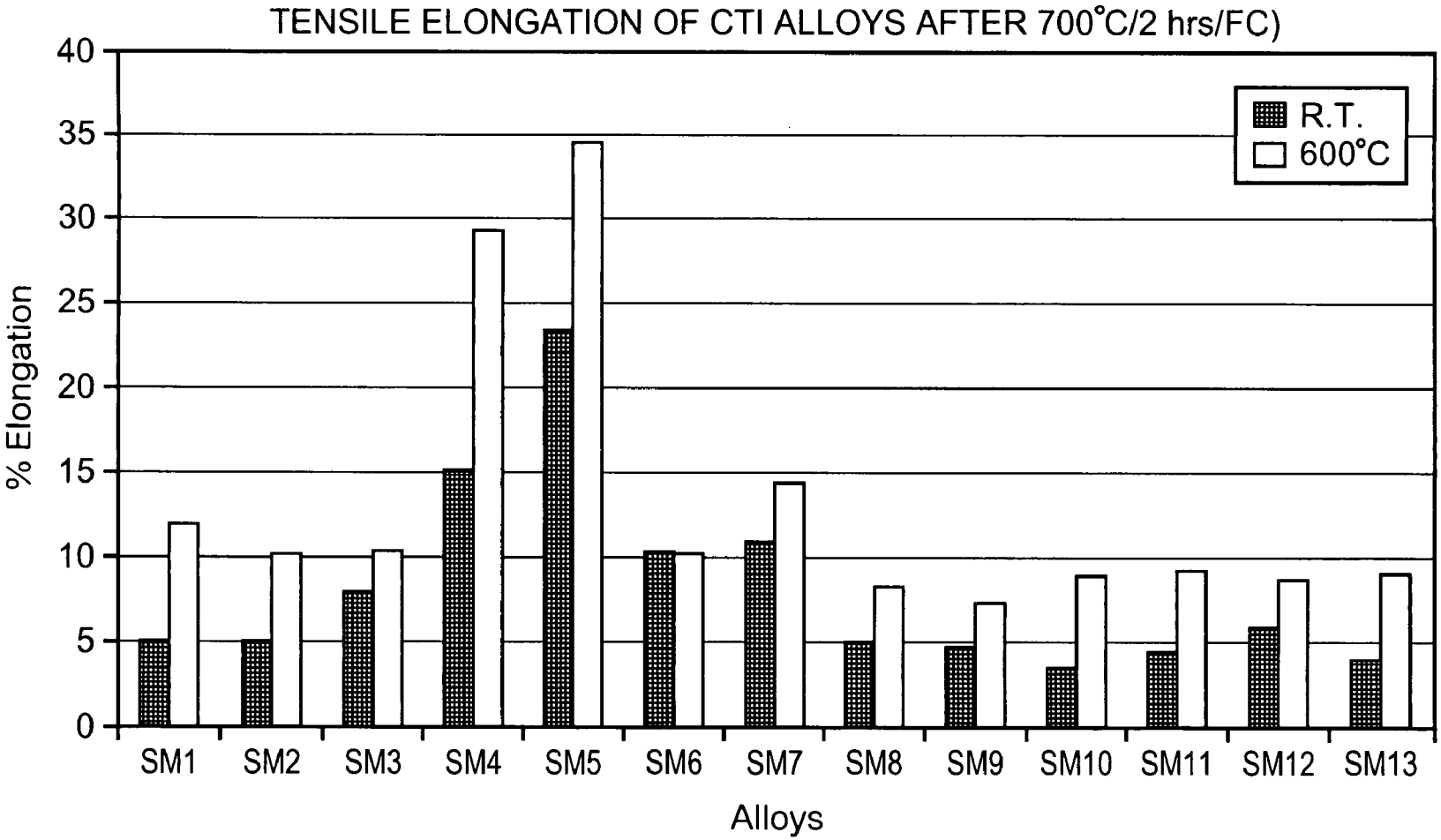
FIGS. 4*a*-4*b* show total elongation at room temperature and at 600° C. for various alloys.
Figure 4B:
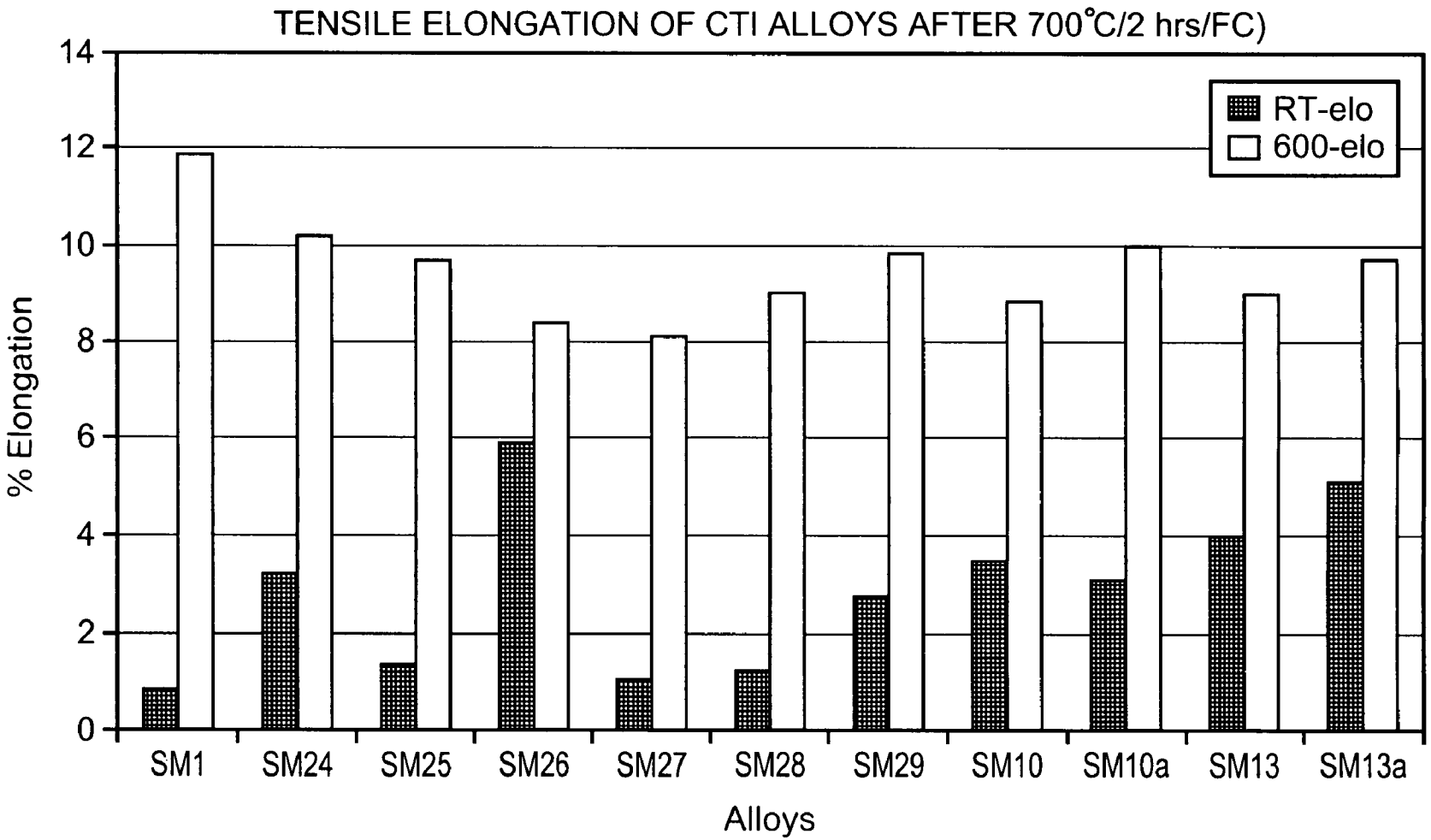

FIGS. 4*a*-4*b* show total elongation for alloys at room temperature and at 600° C. Prior art sample SM-1 is representative of currently available commercial products. For SM-1, the room temperature total elongation is approximately 1%, and at 600° C. the total elongation is approximately 12%. Samples SM-4 and SM-5 show unexpected improvement in total elongation compared to the prior art sample. SM-4 and SM-5 are iron-based Fe—Co—V alloys, SM-5 having higher vanadium than SM-4. The surprising increase in total elongation to greater than approximately 15% at room temperature and greater than approximately 25-30% at 600° C. may be attributed to the increase in vanadium of the base alloy from 4 to over 7 wt. %. Samples SM-6 through SM-13 and SM-24 through SM-29 show total elongations at least as good as those exhibited by the prior art samples.

The alloys can be processed to exhibit desirable combinations of useful properties in the various applications mentioned below. For instance, the alloys can exhibit an ultimate tensile strength of at least 800 MPa at room temperature and 600 MPa at 600° C. Preferably, the alloys exhibit an ultimate tensile strength of at least 1000 MPa at room temperature and 800 MPa at 600° C. The alloys can exhibit a yield strength of at least 700 MPa at room temperature and 400 MPa at 600° C., and preferably such alloys can exhibit yield strengths at room temperature above 800 MPa and above 600 MPa at 600° C. The alloys can exhibit elongation of at least 3.5% at room temperature and at least 7.5% at 600° C. The elongations can be as high as 23% at room temperature and 35% at 600° C.

Figure 5A:
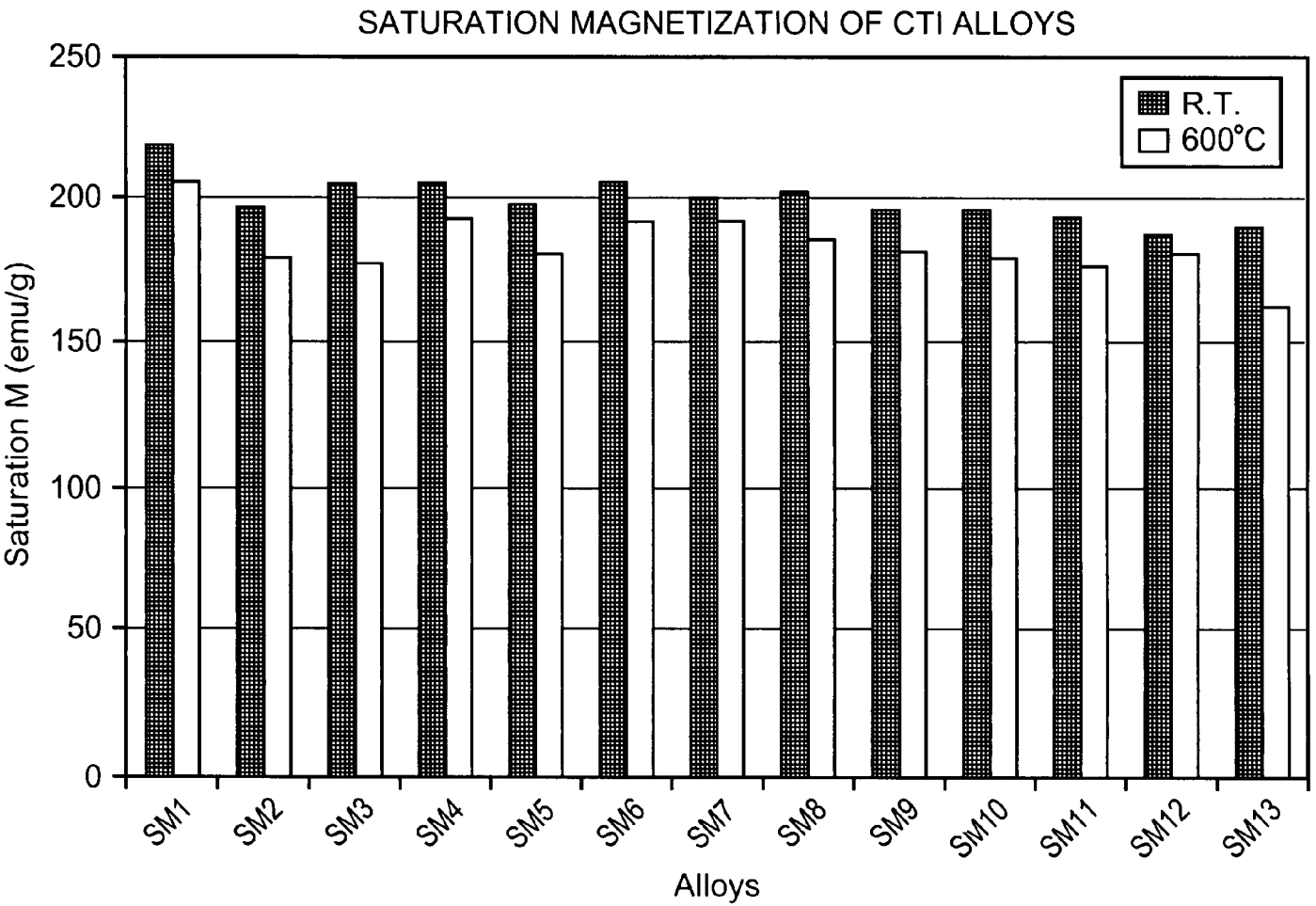
FIGS. 5*a-b* and 6*a-b* show magnetic property measurements (saturation magnetization and coercivity) measured using a magnetometer from room temperature to at least 600° C.
Figure 5B:
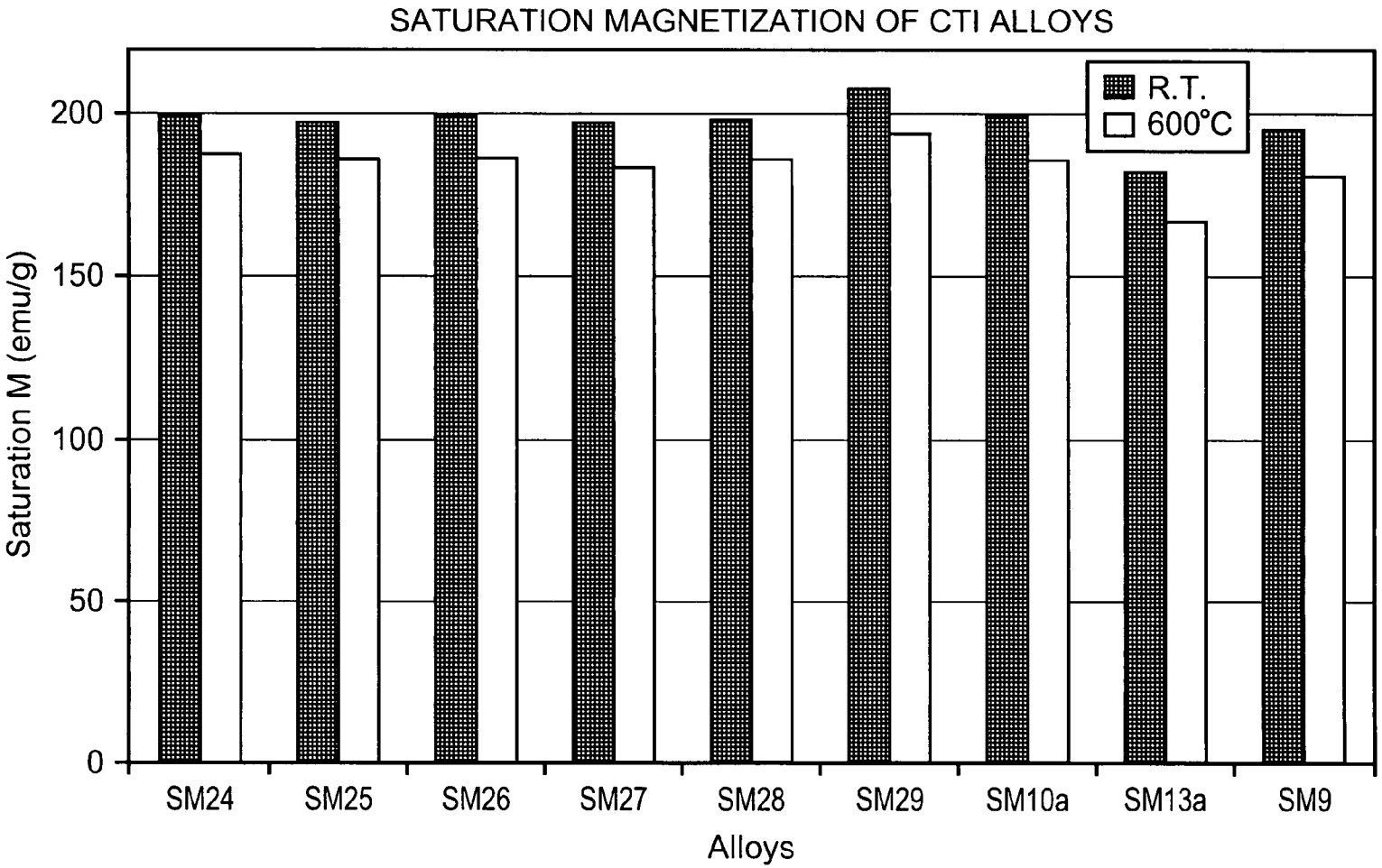
Figure 6A:
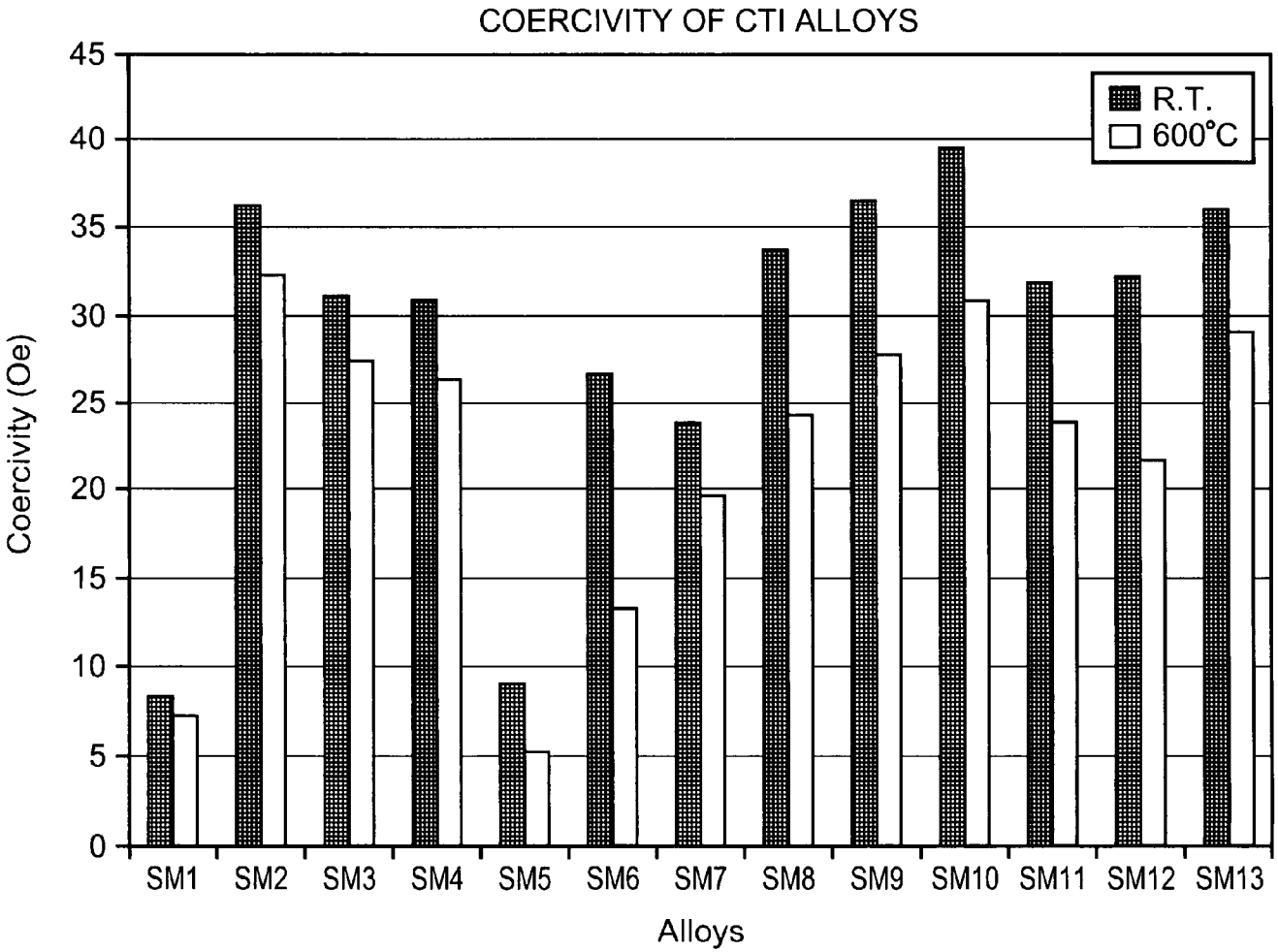
Figure 6B:
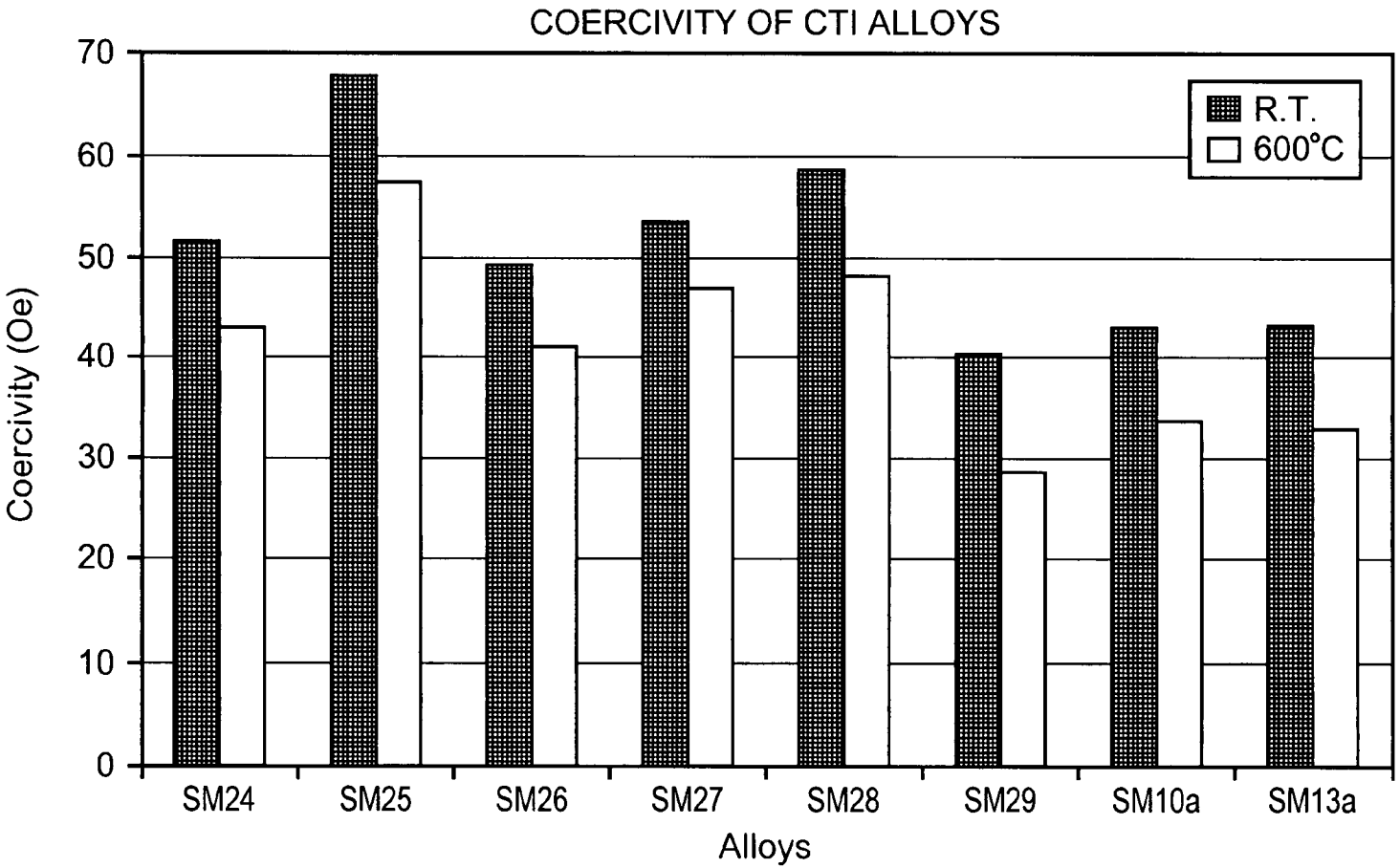
Figure 7:
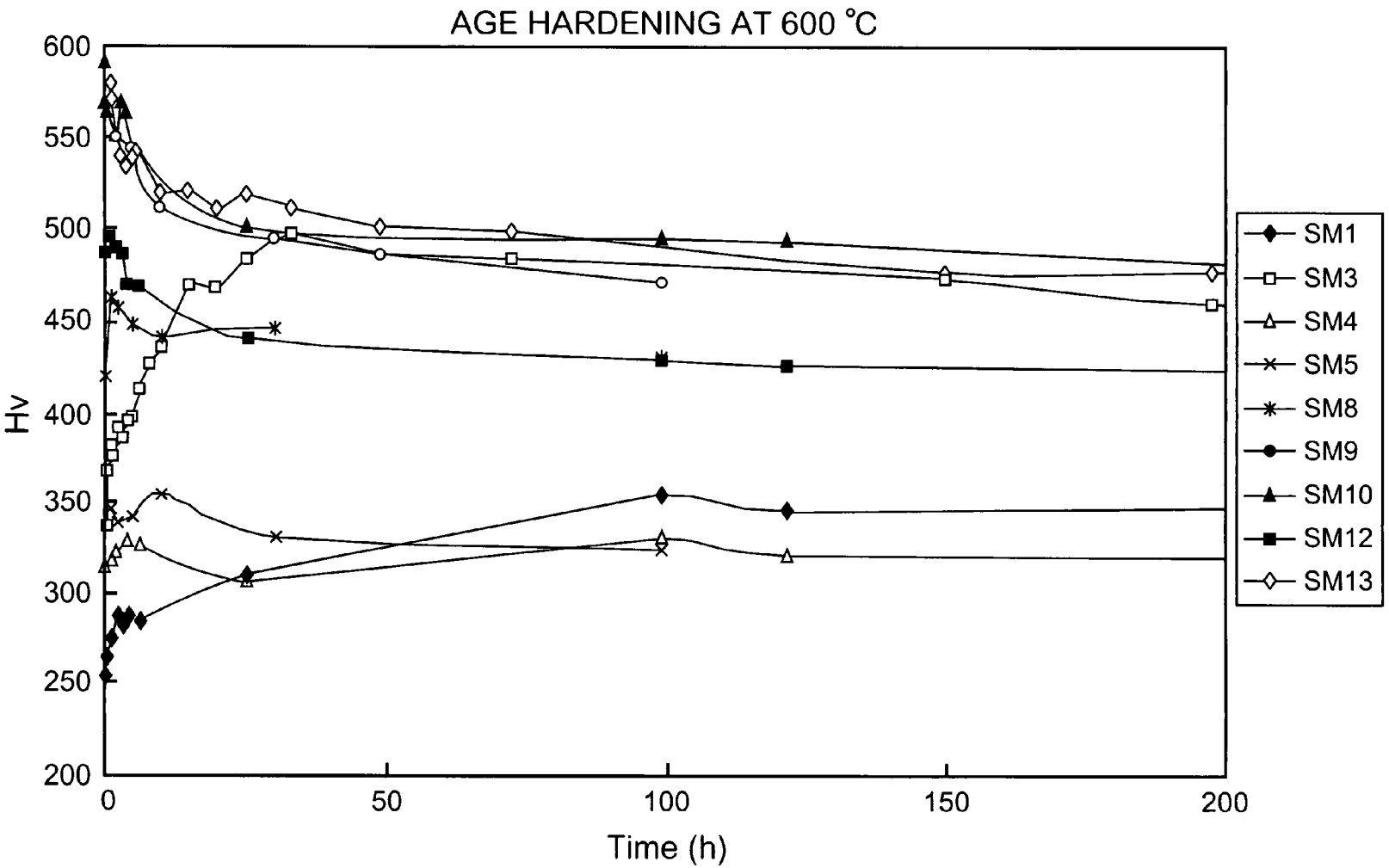
Figure 8A:
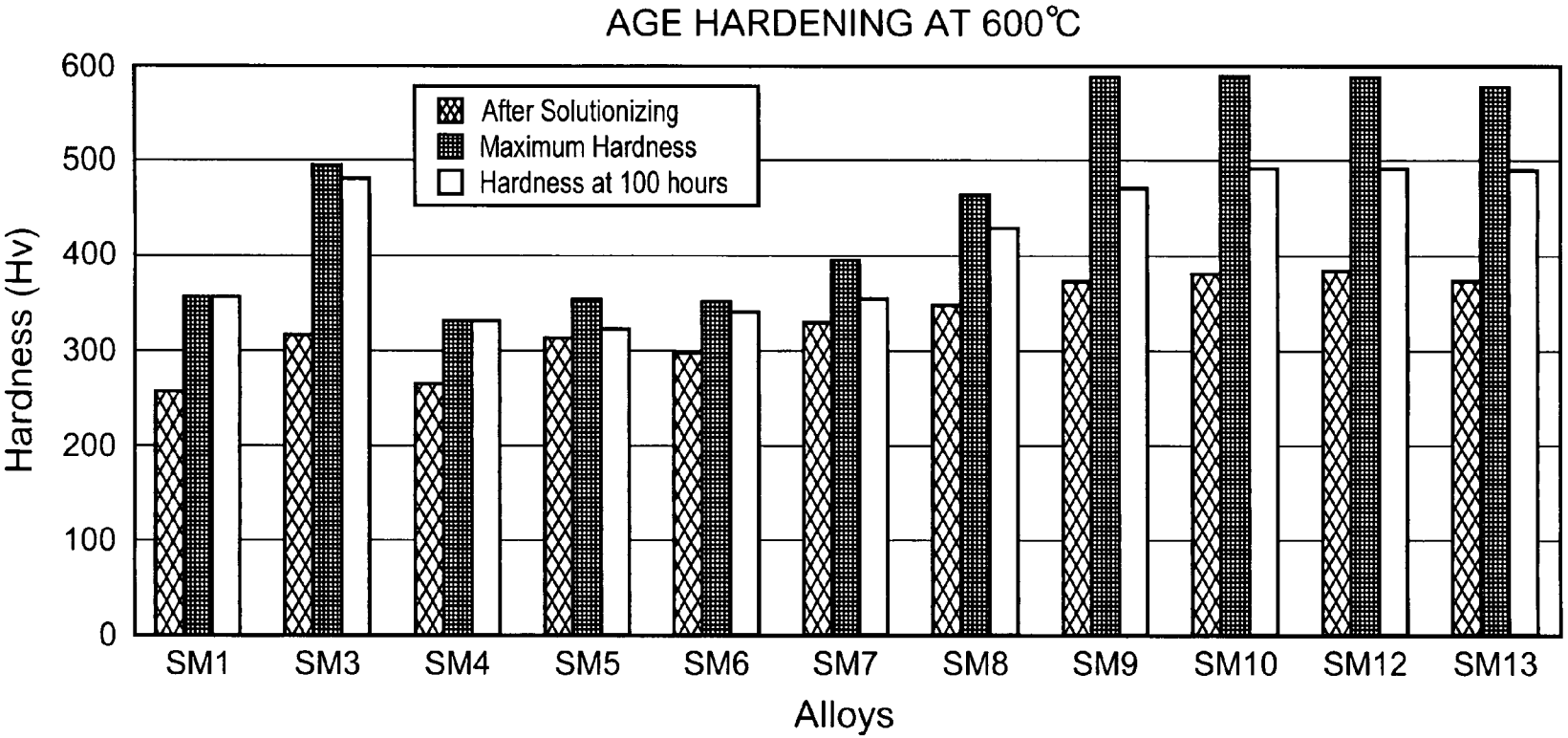
Figure 8B:
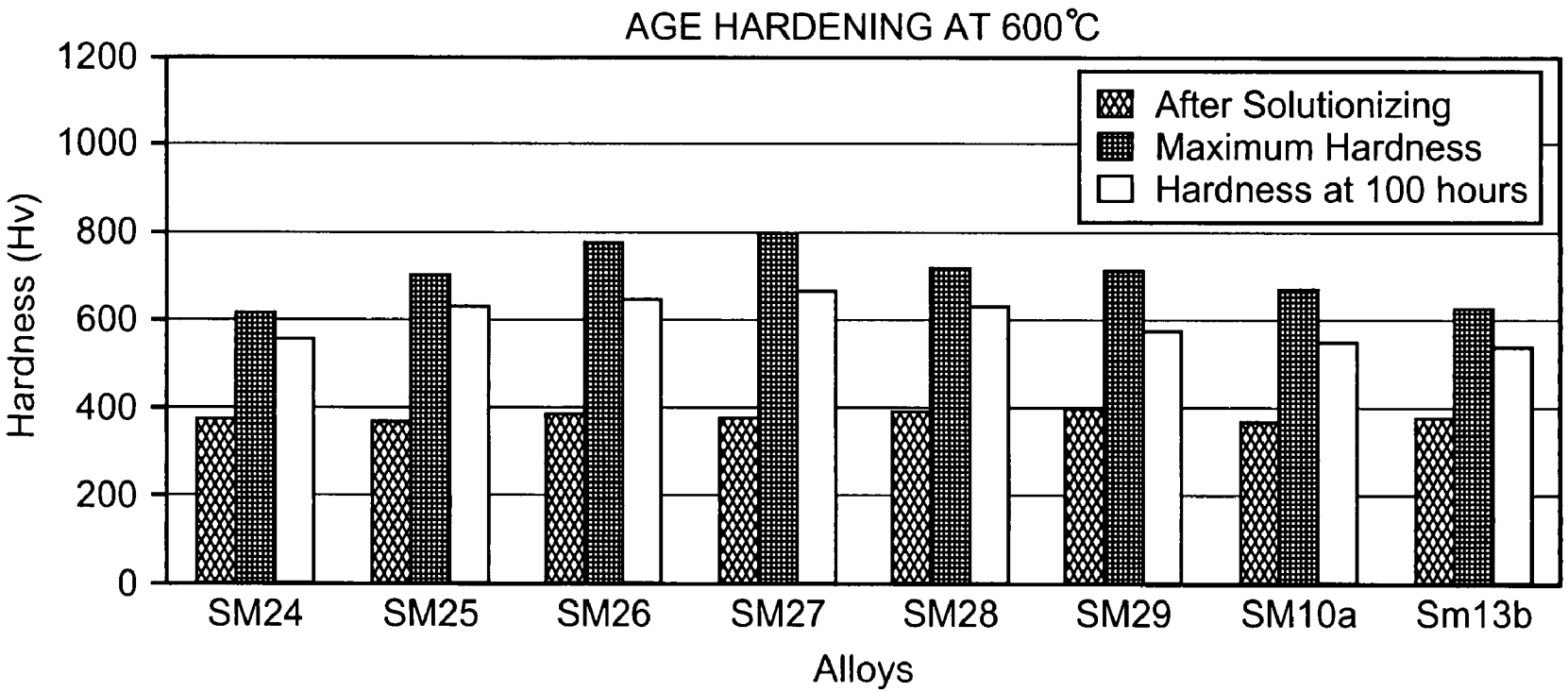
Figure 9:
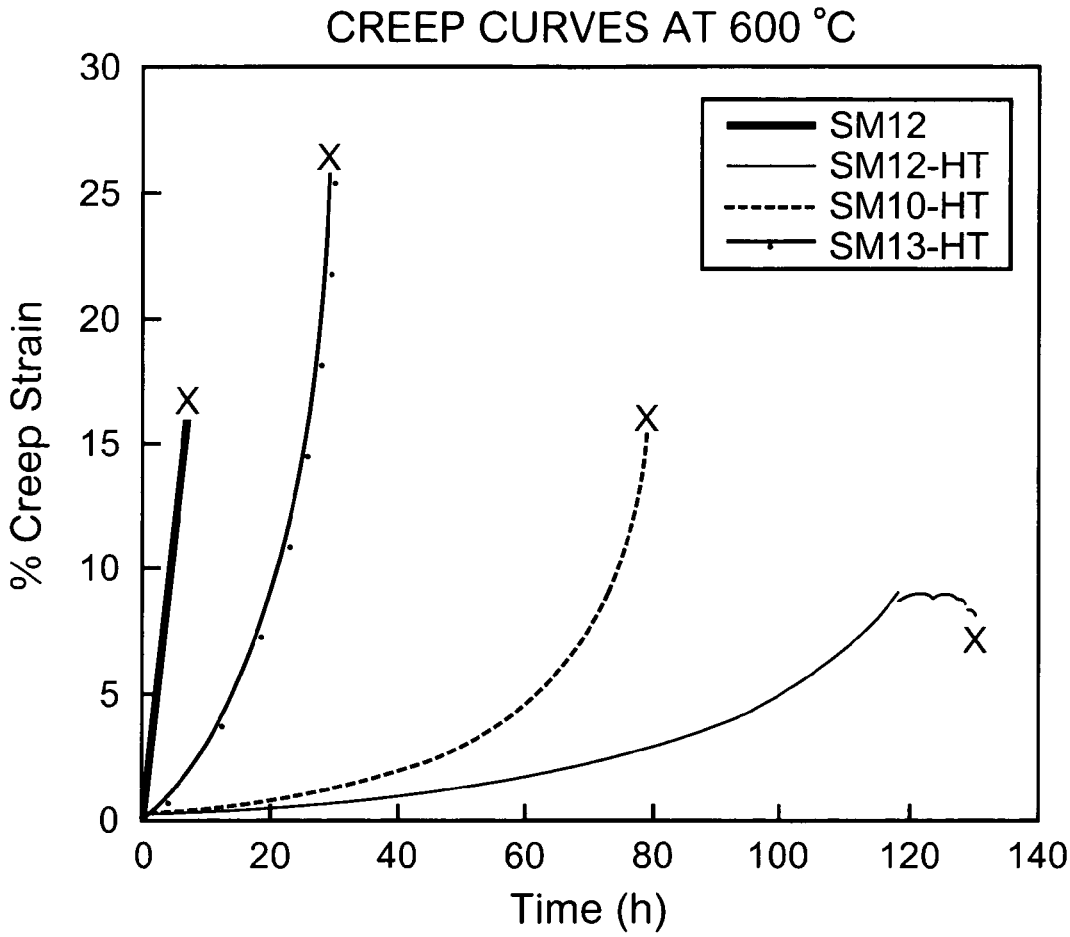
FIG. 9 shows creep data for various alloys tested in air at 600° C. under a stress of 220 MPa with and without the aging treatment (1100° C. for 10 minutes/iced brine quenching/aging at 600° C.) on sheet samples of gauge length of about 18 mm and thickness of about 0.7 mm.

As shown in FIGS. 5*a*-5*b*, the alloys can exhibit a saturation magnetization of at least 190 emu/g at room temperature and, depending on composition, the alloys can exhibit a saturation magnetization of more than 200 emu/g with good retention of such properties at high temperatures, on the order of 600° C.

Figure 10:
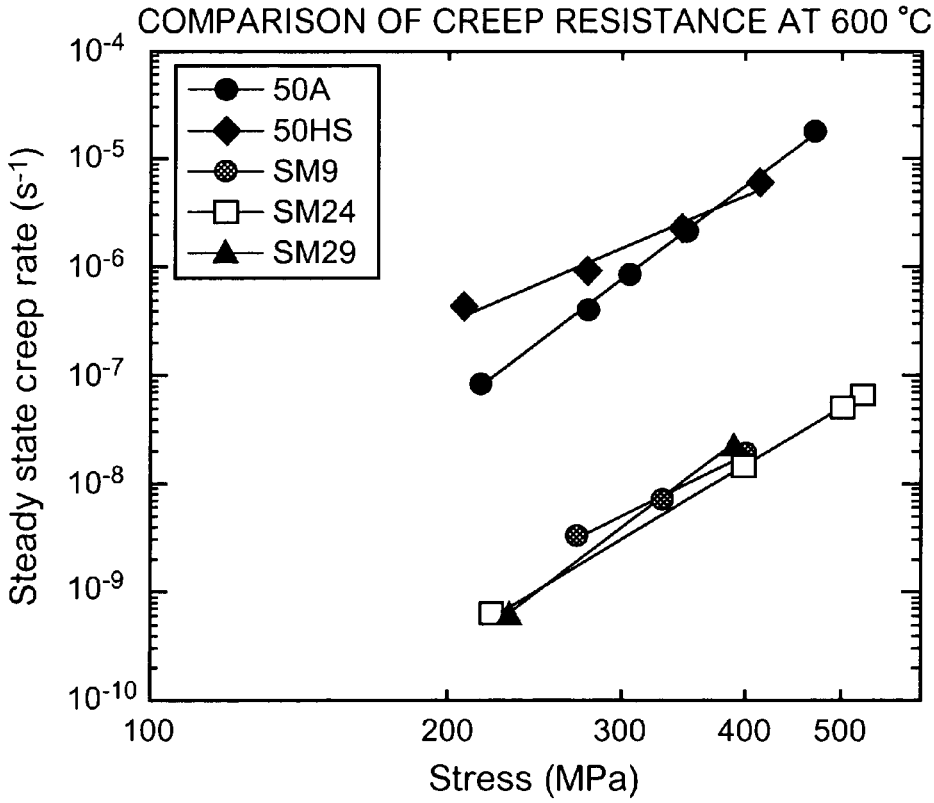
FIG. 10 shows the minimum creep rate at 600° C. as a function of stress applied to the samples.

The alloys preferably exhibit good creep resistance at 600° C. The alloys can exhibit a creep rate of $10^{-10}$ to $10^{-7}$/sec under stresses of 200 to 600 MPa at temperatures on the order of 500 to 650° C. for extended periods of time, such as 5000 hours. As shown in FIG. 10, for example, the alloys can exhibit a creep rate as low as $5\times10^{-8}$ $s^{-1}$ under a stress of 500 MPa at 600° C. The unique combination of high strength and creep resistance, for example, is ideal for high temperature soft magnetic applications.

Figure 11A:
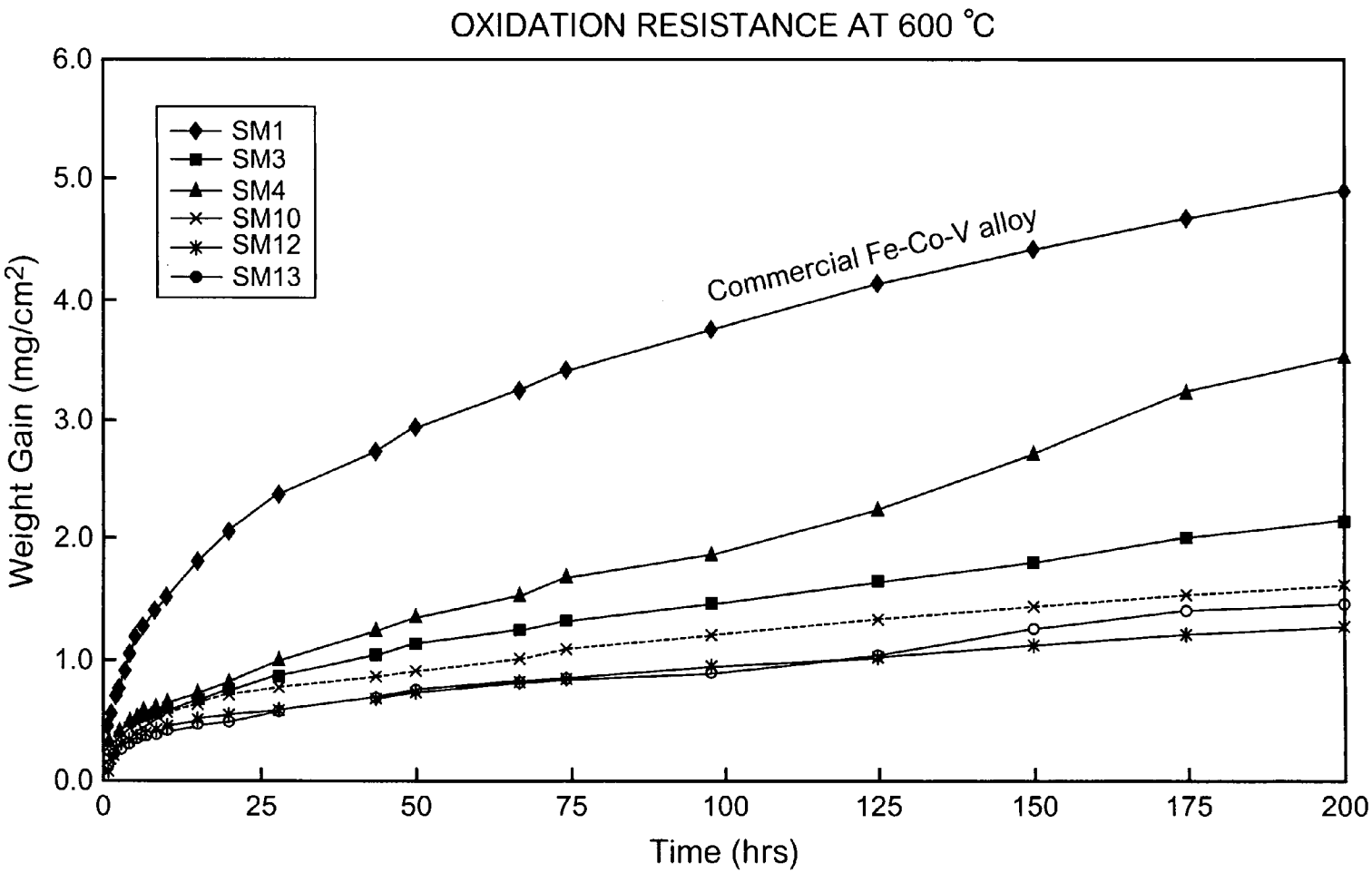
FIGS. 11*a-c* show the static oxidation test results expressed as weight gain as a function of time at 600° C. for various alloys.
Figure 11B:
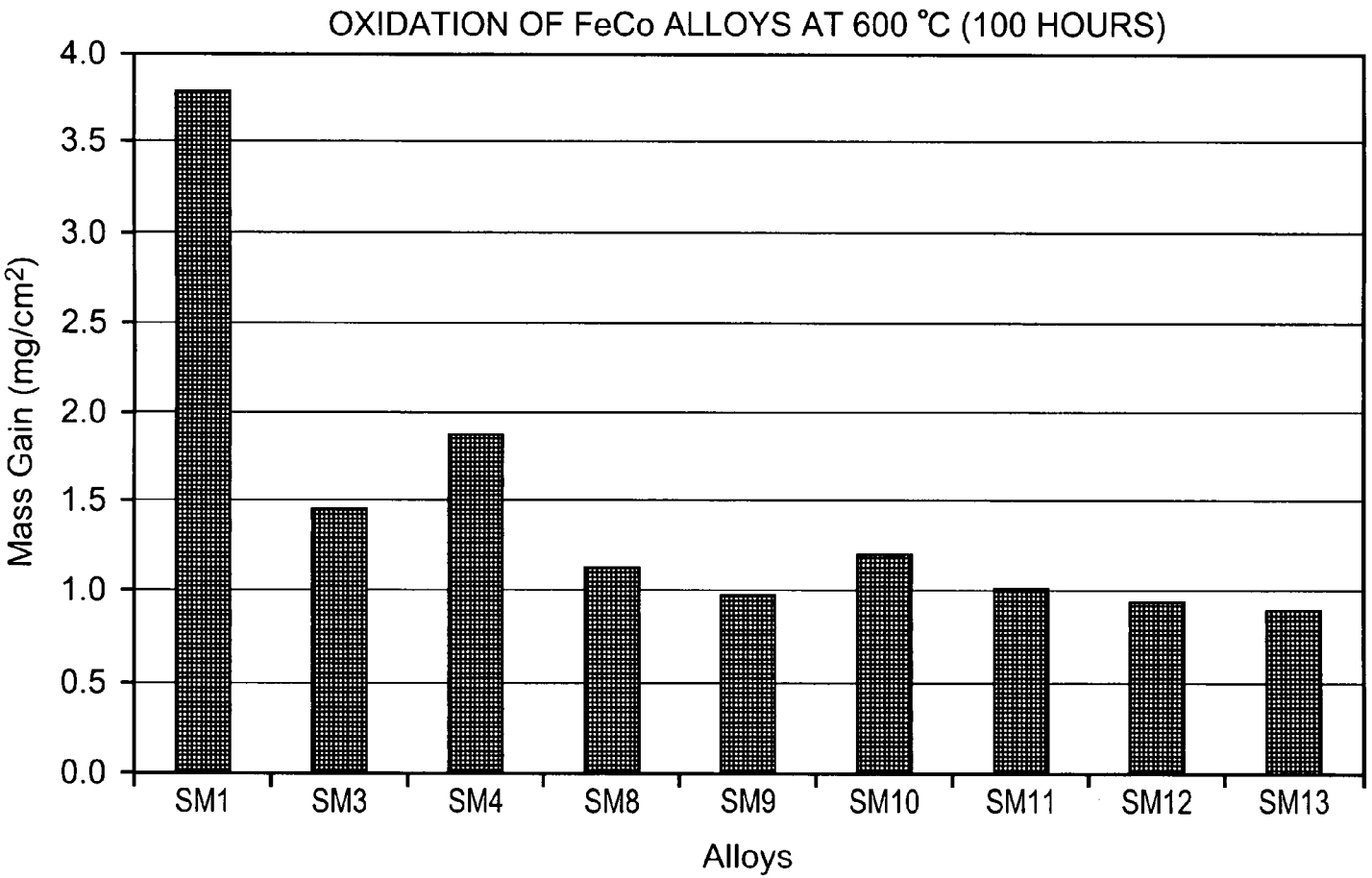
Figure 11C:
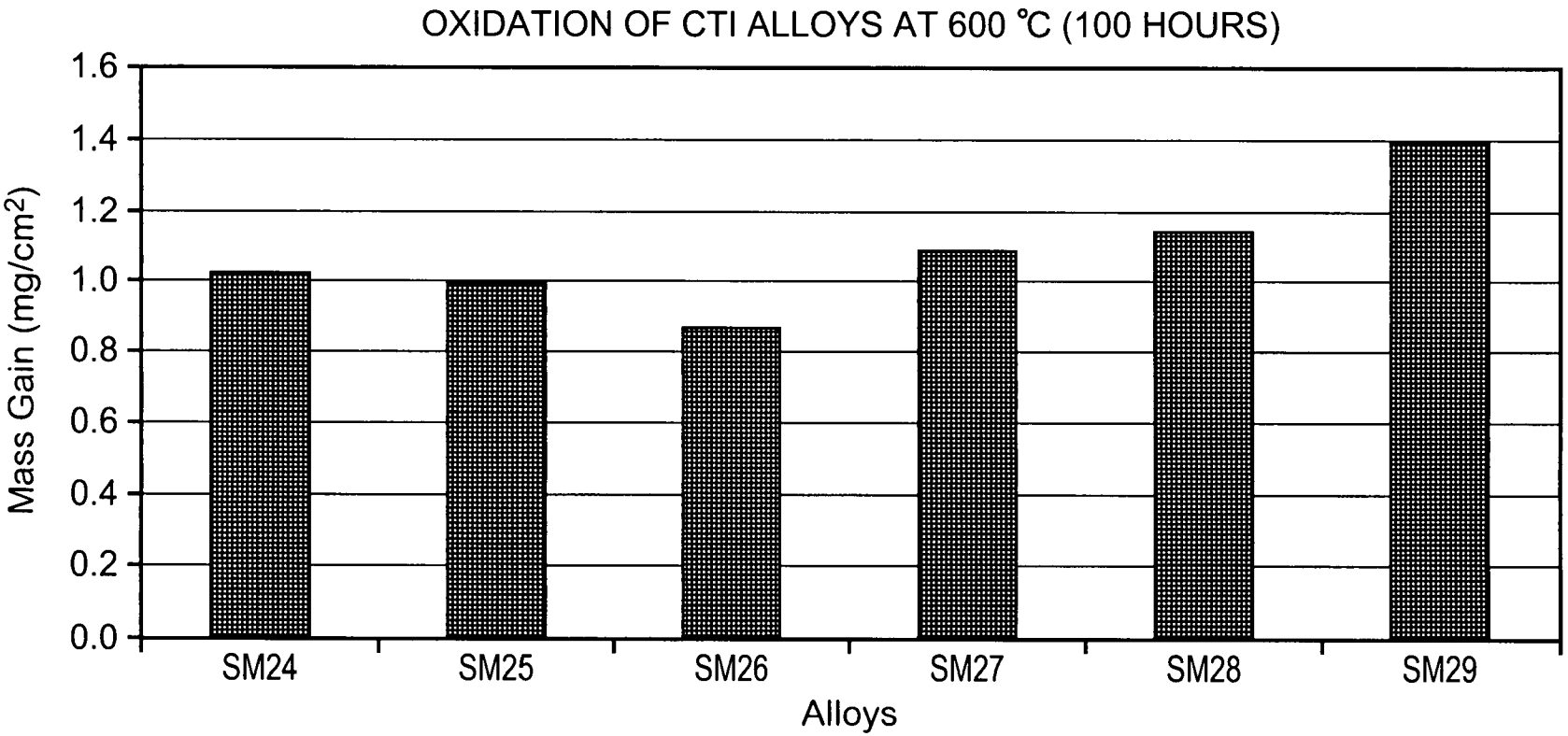

As shown in FIG. 11*a*, SM-3, SM-4, SM-10, SM-12, SM-13 and SM-24 through SM-29 exhibit better oxidation resistance than that of commercially available Fe—Co—V alloys, e.g., a weight gain of less than 3.0 mg/cm$^2$ at 600° C. after 100 hours, and preferably a weight gain of less than 1.5 mg/cm$^2$ at 600° C. after 100 hours.

Figure 12A:
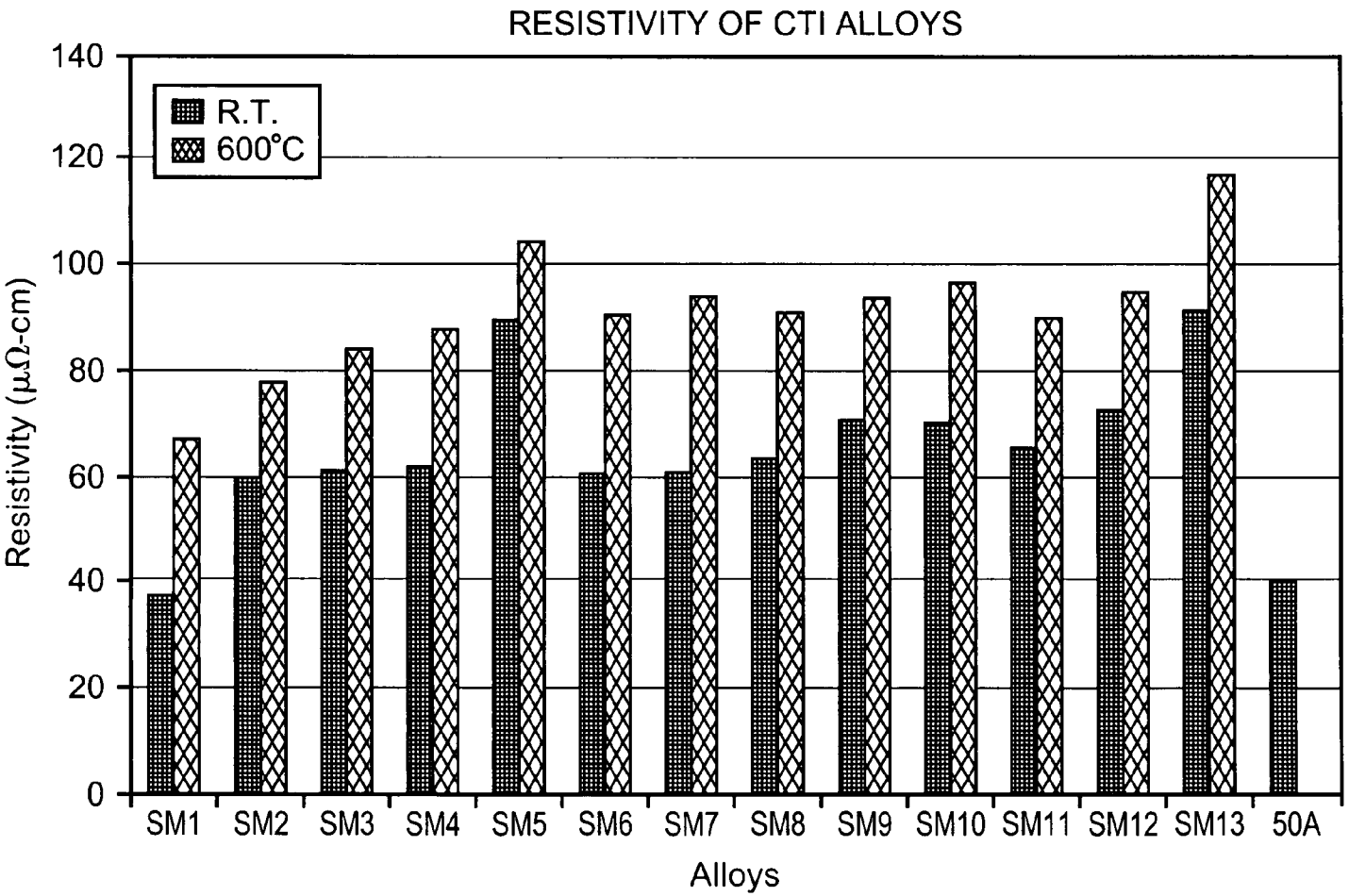
FIGS. 12*a-b* show the electrical resistivity of several alloys as a function of temperature.
Figure 12B:
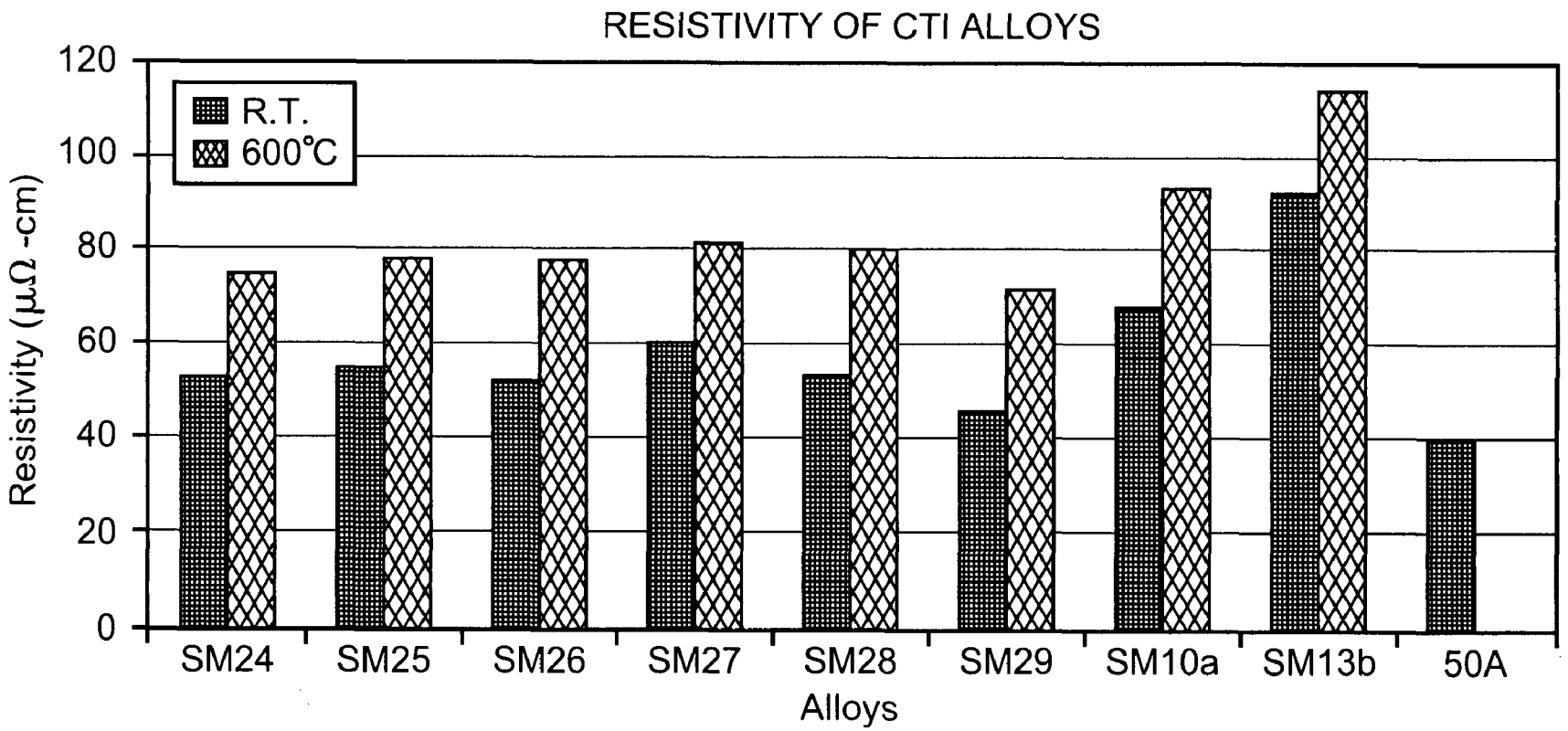
Figure 13:
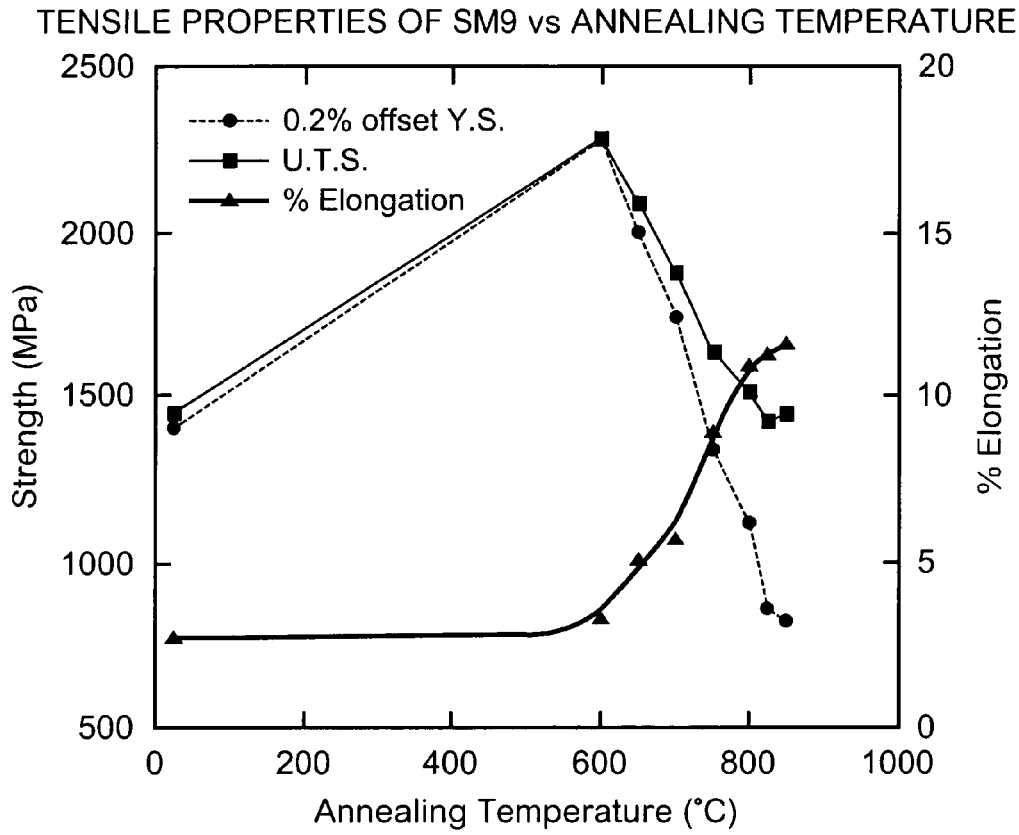
FIGS. 13-14 compare the influence of annealing temperature on the tensile properties.
Figure 14:
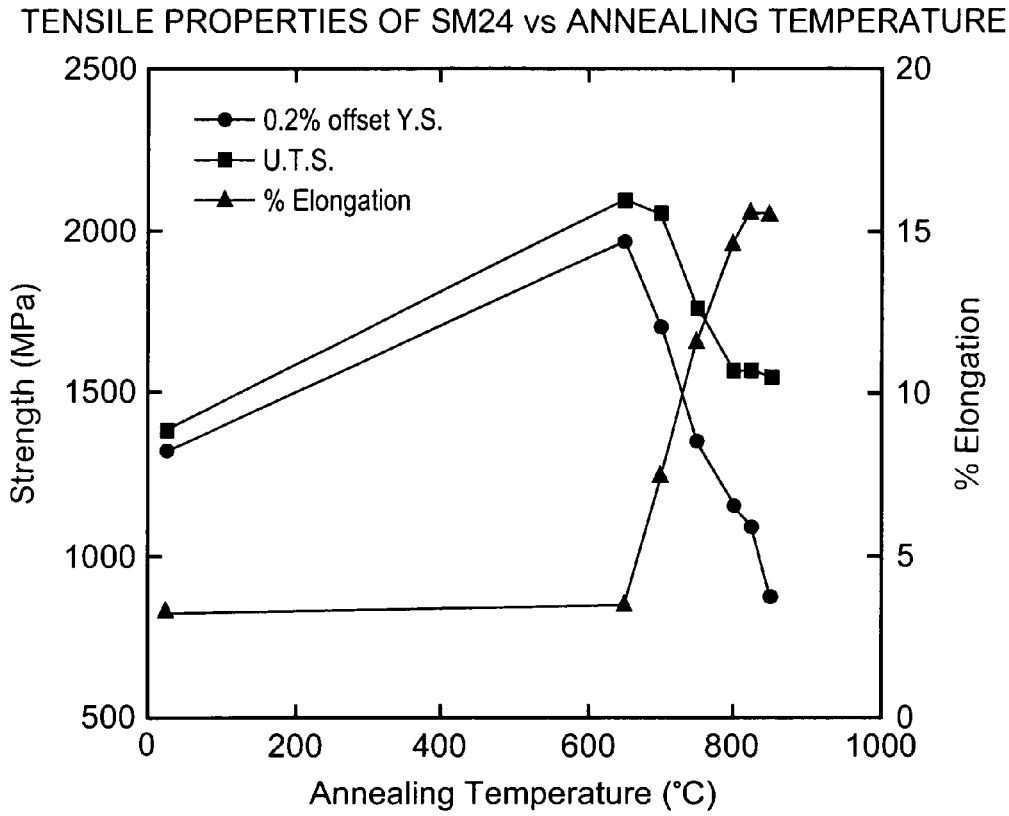
Figure 15:
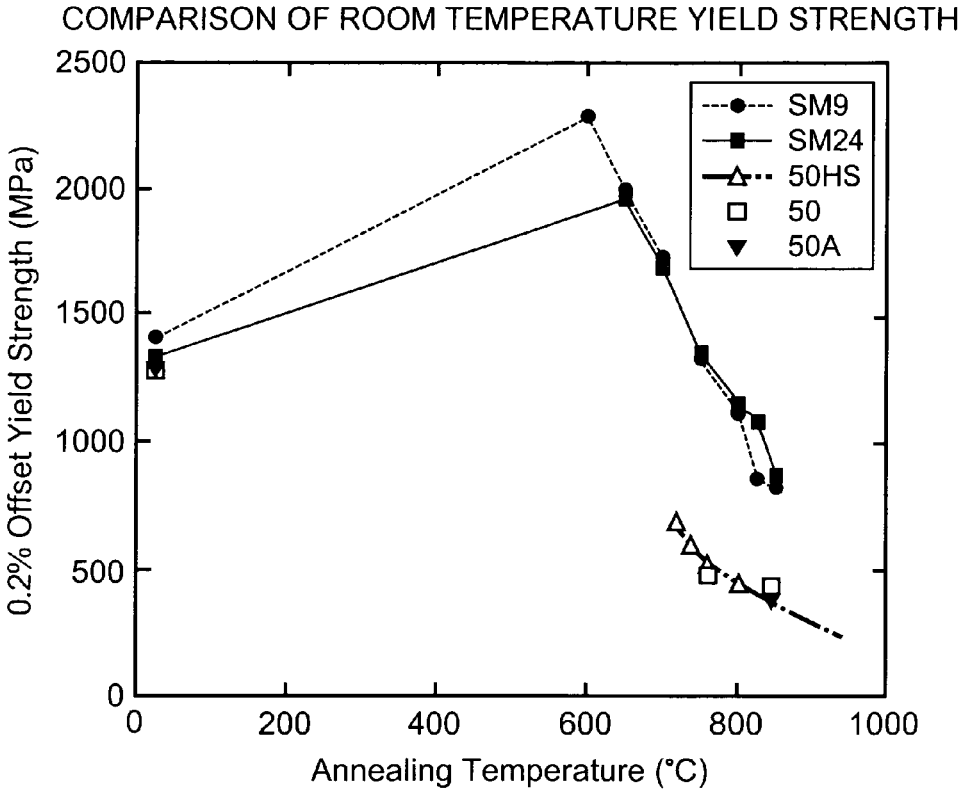
FIG. 15 shows room temperature yield strength as a function of annealing temperature for various alloys.

Alloys SM-2 through SM-29 exhibit high electrical resistivity, e.g., 40 to 100 micro-ohm-cm. As shown in FIGS. 12*a* and 12*b*, the electrical resistivities of SM-2 through SM-13 are at least 50% higher than the resistivity of conventional alloys. The alloys can exhibit an electrical resistivity at 600° C. greater than 80 micro-ohm-cm, preferably greater than 100 micro-ohm-cm. A high resistivity is beneficial in applications involving alternating currents because a high resistivity advantageously reduces high frequency eddy current losses. Therefore, these alloys will reduce the eddy current losses compared to currently existing commercial alloys, e.g., up to 50% reduction in eddy current losses.

Inventive alloys SM-2 through SM-29 have been developed to provide next generation iron-cobalt-vanadium alloys as magnetic materials with exceptional high strength. Table 1 has provided the compositions of soft magnetic alloys designed to meet these goals. Various alloying additions can be used to improve the strength at room temperature and retain the strength at high temperatures. It is most preferable to obtain alloys exhibiting exceptionally good creep resistance up to 600° C. for a period of up to 5,000 hours. The tensile and yield strengths of these alloys indicate that the strengths of SM-2 through SM-29 are significantly higher than the prior art commercial alloys. In addition, several alloys provide a yield strength of at least 800 MPa at room temperature. Indeed, one of the alloys, SM-13, has a yield strength of over 1,300 MPa with a tensile strength of about 1,600 MPa. Such a material would be very useful for high strength applications. In addition, the alloys exhibit a high Curie temperature ($T_c$), e.g., a Curie temperature on the order of 920 to 950° C. as well as good formability, dynamic properties in the form of laminated composites, and a good cost to performance ratio.

Magnetic and mechanical properties of Fe—Co alloys are very sensitive to the final heat treatment conditions. Commercial Fe—Co alloys are sold in the cold-rolled condition, and an annealing temperature in the range of 700 to 900° C. is recommended to optimize the mechanical and magnetic properties of the alloy. In processing such commercial Fe—Co alloys, increased annealing temperatures are deleterious to the yield strength while the magnetic properties are improved considerably at higher annealing temperatures. Even with lower annealing temperatures, corresponding to a higher tensile strength, the creep resistance of such commercial Fe—Co alloys is inadequate.

According to an embodiment, the alloys are processed by a dual heat treatment. A preferred dual heat treatment includes annealing of the alloy, preferably in the cold rolled condition, at a temperature greater than 800° C. for up to 3 hr. followed by quenching and aging in the temperature range from between 550 to 750° C. up to 120 hr. A preferred annealing time is from 5 to 180 min., with shorter annealing times being preferred at higher temperatures. A preferred aging time is between 1 to 20 hours. When the Fe—Co alloys are subjected to a dual heat treatment, a room temperature yield strength of at least 800 MPa, and preferably at least 1200 MPa with a ductility of 3 to 10% can be attained. The minimum creep rate at 600° C. and 500 MPa can be $6\times10^{7}$/sec or better, which is two orders of magnitude lower than the creep rate for commercially available Fe—Co alloys.

In the preferred embodiment of the invention, a dual heat treatment is provided to attain good room temperature tensile properties (high strength and ductility) and better creep resistance for alloys SM9 and SM24, as shown in Tables 2-3. In Tables 2-3, AR stands for as-received (the process conditions for SM9 and SM24 to arrive at the AR condition are set forth in Table 5); WQ stands for water quench; IBQ stands for ice brine quench; and AC stands for air cool.

TABLE 2a

Summary of Tensile Results on SM9

| Heat treatment condition | 0.2% Y.S. (MPa) | U.T.S. (MPa) | % Elongation |
|---|---|---|---|
| AR | 1401.0 | 1445.5 | 2.8 |
| 600° C./1 h/AC | 2282.6 | 2283.7 | 3.3 |
| 650° C./1 h/AC | 2004.4 | 2090.8 | 5.1 |
| 650° C./20 h/AC | 1686.1 | 1965.2 | 6.4 |
| 700° C./1 h/AC | 1738.8 | 1876.8 | 5.7 |
| 750° C./1 h/AC | 1335.4 | 1632.6 | 8.9 |
| 800° C./1 h/AC | 1117.3 | 1507.4 | 10.9 |
| 825° C./1 h/AC | 861.8 | 1421.8 | 11.3 |
| 850° C./1 h/AC | 825.0 | 1443.1 | 11.6 |
| 900° C./1 h/AC | 1088.1 | 1393.8 | 7.3 |
| 950° C./1 h/AC | 1005.8 | 1288.2 | 7.9 |

TABLE 2a-continued

Summary of Tensile Results on SM9

| Heat treatment condition | 0.2% Y.S. (MPa) | U.T.S. (MPa) | % Elongation |
|---|---|---|---|
| Dual Heat Treatment | | | |
| 1000° C./5 min/WQ + 600° C./1 h/AC | 1473.0 | — | 0.6 |
| 1000° C./2 min/WQ + 600° C./20 h/AC | 1768.0 | 2027.6 | 9.3 |
| 950° C./1 h/AC + 600° C./1 h/AC | 819.5 | — | 0.3 |
| 950° C./1 h/WQ + 600° C./1 h/AC | 792 | — | 0.5 |
| 950° C./5 min/WQ + 600° C./1 h/AC | 1481.9 | 1855.9 | 8.9 |
| 950° C./5 min/WQ + 600° C./20 h/AC | 1515.9 | 1907 | 8.7 |
| 950° C./10 min/WQ + 600° C./20 h/AC | 1577.7 | 1676.8 | 3.6 |
| 925° C./1 h/WQ + 600° C./1 h/AC | 1491.2 | 1892.9 | 10.2 |
| 925° C./30 min/WQ + 600° C./1 h/AC | 1646.7 | 1977.5 | 9.0 |
| 925° C./10 min/WQ + 600° C./1 h/AC | 1438.5 | 1980.8 | 9.3 |
| 900° C./1 h/WQ + 600° C./1 h/AC | 1320.1 | 1796.1 | 9.9 |
| 900° C./30 min/WQ + 600° C./1 h/AC | 1272.0 | 1807.4 | 10.1 |
| 900° C./10 min/WQ + 600° C./1 h/AC | 1210.0 | 1718.0 | 9.5 |
| 850° C./1 h/WQ + 600° C./1 h/AC | 973.3 | 1522.6 | 10.4 |

TABLE 2b

High Temperature Tensile Results on SM9

| Heat treatment condition | Test temp. (° C.) | 0.2% Y.S. (MPa) | U.T.S. (MPa) | % Elongation |
|---|---|---|---|---|
| 925° C./1 h/WQ + 600° C./1 h/AC | 200 | 1268.9 | 1499.6 | 6.3 |
| 925° C./1 h/WQ + 600° C./1 h/AC | 300 | 1284.3 | 1540.7 | 7.7 |
| 925° C./1 h/WQ + 600° C./1 h/AC | 400 | 1199.7 | 1441.6 | 7.8 |
| 925° C./1 h/WQ + 600° C./1 h/AC | 500 | 1161.1 | 1390.8 | 7.0 |
| 925° C./1 h/WQ + 600° C./1 h/AC | 600 | 993.1 | 1117.4 | 6.5 |
| 950° C./5 min/WQ + 600° C./1 h/AC | 600 | 850.1 | 912.2 | 10.1 |

TABLE 2c

Summary of Creep Results on SM9

| Heat treatment | Test Condition | Minimum Creep Rate | Rupture life (h:min) |
|---|---|---|---|
| 1100° C./10 min/IBQ + 600° C./6 h | 600° C. and 500 MPa | $5.1 \times 10^{-8}$ | 82:34 |
| 850° C./1 h/AC | 600° C. and 400 MPa | $4.1 \times 10^{-7}$ | 23:30 |
| 950° C./5 min/WQ + 600° C./1 h/AC | 600° C. and 500 MPa | $2.0 \times 10^{-7}$ | 31:53 |
| 950° C./5 min/WQ + 600° C./20 h/AC | 600° C. and 500 MPa | $5.3 \times 10^{-7}$ | 28:26 |
| 925° C./1 h/WQ + 600° C./1 h/AC | 600° C. and 500 MPa | $1.5 \times 10^{-7}$ | 60:13 |
| 925° C./2 h/WQ + 600° C./1 h/AC | 600° C. and 500 MPa | $1.8 \times 10^{-7}$ | 38:54 |
| 925° C./1 h/WQ + 650° C./1 h/AC | 600° C. and 500 MPa | $2.4 \times 10^{-7}$ | 35:07 |
| 950° C./5 min/WQ + 650° C./1 h/AC | 600° C. and 500 MPa | $5.6 \times 10^{-7}$ | 19:13 |
| 925° C./1 h/WQ + 675° C./1 h/AC | 600° C. and 500 MPa | $3.9 \times 10^{-7}$ | 26:00 |
| 925° C./1 h/WQ + 600° C./1 h/AC | 600° C. and 400 MPa | $5.3 \times 10^{-8}$ | 211:10 |
| 925° C./1 h/WQ + 600° C./1 h/AC | 600° C. and 350 MPa | $2.5 \times 10^{-8}$ | 513:12 |
| 925° C./1 h/WQ + 600° C./1 h/AC | 600° C. and 300 MPa | $1.4 \times 10^{-8}$ | 588:44 |

TABLE 3a

| Summary of Tensile Results on SM24 | | | |
|---|---|---|---|
| Heat treatment condition | 0.2% Y.S. (MPa) | U.T.S. (MPa) | % Elongation |
| AR | 1329.79 | 1393.2 | 3.3 |
| 600° C./1 h/AC | 2060.9 | — | 0.8 |
| 650° C./1 h/AC | 1966.6 | 2097.8 | 3.5 |
| 700° C./1 h/AC | 1700.4 | 2055.6 | 7.5 |
| 750° C./1 h/AC | 1352.0 | 1760.7 | 11.6 |
| 800° C./1 h/AC | 1156.5 | 1568.9 | 14.6 |
| 825° C./1 h/AC | 1060 | 1570.7 | 15.6 |
| 850° C./1 h/AC | 871.4 | 1548.5 | 15.5 |
| 900° C./1 h/AC | 1007 | 1359.6 | 16.3 |
| 950° C./1 h/AC | 1110.7 | 1379.3 | 3.4 |
| Dual Heat Treatment | | | |
| 900° C./5 min/WQ + 600° C./1 h/AC | 1548.9 | 2086.8 | 3.8 |
| 950° C./5 min/WQ + 600° C./1 h/AC | 2019.6 | 2289.8 | 4.8 |
| 1000° C./5 min/WQ + 600° C./1 h/AC | 1195.7 | 1195.7 | 0.5 |
| 850° C./1 h/WQ + 600° C./1 h/AC | 1112.6 | 1806.2 | 11.6 |
| 925° C./1 h/WQ + 600° C./1 h/AC | 1931.2 | — | 0.9 |
| High Temperature Tensile Results (600° C.) | | | |
| 925° C./1 h/WQ + 600° C./1 h/AC | 1096.52 | 1343.6 | 6.7 |
| 950° C./5 min/WQ + 600° C./1 h/AC | 829.8 | 937.2 | 16.4 |

600° C. for 1 hr. Following the dual heat treatment, alloy SM9 exhibited a room temperature yield strength of about 1490 MPa and a ductility of about 10%. Furthermore, when creep tested at 600° C. and 500 MPa, the SM9 alloy exhibited a minimum creep rate of $2\times10^{-7}$/sec. This unique combination of mechanical properties is superior to that found in commercially available Fe—Co alloys.

The iron-cobalt alloys according to a preferred embodiment of the invention have improved strength and creep resistance as well as good magnetic properties and oxidation resistance. The alloys can include additions of V, B, C, Mo, Nb, W, Ni, Ti, Cr, Mn, Al and mixtures thereof. For instance, the alloys can include, in weight percent, 30 to 51% Co; 0 to 8% V; 0.001 to 0.02% B; 0 to 0.1% C; 0.4 to 3% Mo; 0.4 to 2% Nb; 1 to 5% W; 1 to 2% Ni; 0.3 to 2% Ti; 1 to 2 wt. % Cr; 0.25 to 3 wt. % Mn and/or 0.5 to 1.5% Al, with the balance Fe and incidental impurities.

By way of example, the SM-9 alloy advantageously possesses properties useful across a wide array of applications. The yield strength of the SM-9 alloy at room temperature is in the range of 970 to 1400 MPa and at 600° C. is at least 690 MPa. Total elongation (ductility) at room temperature is 3.4% and at 600° C. is about 7.2%. Measurement of the creep strength (at 600° C. and 300 to 500 MPa) revealed a minimum creep rate of $6\times10^{-7}$ $s^{-1}$ or better and a rupture life of 24 hrs.

TABLE 3b

| Summary of Creep results on SM24 | | | |
|---|---|---|---|
| Heat treatment | Expt. Condition | Minimum Creep Rate | Rupture life (h:min) |
| 1100° C./10 min/IBQ + 600° C./6 h | 540° C. and 520 MPa | $1.4\times10^{-9}$ | 385:12 |
| 1100° C./10 min/IBQ + 600° C./6 h | 600° C. and 220 MPa | $5.6\times10^{-10}$ | test stopped after reaching 0.5% strain in 1581 h and 29 min |
| 1100° C./10 min/IBQ + 600° C./6 h | 600° C. and 500 MPa | $1.4\times10^{-8}$ | 464:55 |
| 700° C./2 h/AC | 600° C. and 270 MPa | $1.1\times10^{-7}$ | 352:27 |
| 650° C./1 h/AC | 600° C. and 400 MPa | $5.1\times10^{-7}$ | 55:26 |
| 700° C./1 h/AC | 600° C. and 500 MPa | $1.2\times10^{-5}$ | 3:15 |
| 800° C./1 h/AC | 600° C. and 500 MPa | $8.1\times10^{-6}$ | 5:31 |
| 925° C./1 h/WQ + 600° C./1 h/AC | 600° C. and 500 MPa | $2.3\times10^{-7}$ | 100:23 |
| 950° C./5 min/WQ + 600° C./1 h/AC | 600° C. and 500 MPa | $5.3\times10^{-7}$ | 19:13 |

The compositions of preferred alloys can be tailored to respond to the dual heat treatment. In the first stage of the heat treatment the cold-rolled alloy is annealed at temperatures greater than 800° C. for an optimum annealing time, which depends on the annealing temperature, followed by cooling the alloy to room temperature. Water quenching from high temperature annealing is the recommended method of cooling to room temperature. In order to fine tune the magnetic properties, however, either air cooling or cooling at a desired cooling rate could be employed. The alloy is then subjected to an aging treatment at a temperature from between 550 to 750° C., preferably 600 to 700° C. for a desired annealing time. Annealing for 1 hr. at the selected annealing condition, for example, is sufficient to attain a good combination of strength and creep properties. For example, alloy SM24 was cold-rolled, annealed at 950° C. anneal for 5 min., water quenched, and aged at 600° C. for 1 hr. Following the dual heat treatment, alloy SM24 exhibited a room temperature yield strength of about 2000 MPa and a ductility of about 5%. Furthermore, when creep tested at 600° C. and 500 MPa, the SM24 alloy exhibited a minimum creep rate of $6\times10^{-7}$/sec or better. In a further example, alloy SM9 was cold rolled, annealed at 925° C. for 1 hour, water quenched, and aged at or better, as shown in Table 2c. The SM-9 alloy displays a room temperature electrical resistivity of about 70 μΩ-cm and a high saturation magnetization, 196 emu/gram.

The alloys are useful for various applications including: internal starter/generator for aircraft jet engines, high performance transformers, laminated material for electrical engines and generators, pole tips for high field magnets, magnetically driven actuators for devices such as impact printers, diaphragms for telephone handsets, solenoid valves of armature-yoke systems such as in diesel direct fuel injection engines, magnetostrictive transducers, electromagnetically controlled intake and exhaust nozzles, flux guiding parts in inductive speed counters for anti-lock brake systems, magnetic lenses, solenoid cores for fast response magnetic switches, magnetic circuits operated at high frequencies, etc.

Preferred alloys exhibit other properties desirable in such environments such as a yield strength of at least 700 MPa, an electrical resistivity of 40 to 60 micro-ohm-cm, a high creep resistance at 550° C., and good corrosion resistance.

Because the alloys exhibit high strength at high temperatures while providing desired magnetic properties, they are useful as bearings, stators and/or rotors of internal starter/generator units for aircraft jet engines wherein the operating temperatures can be on the order of 550° C. while such parts are subject to alternating magnetic fields of 2 Tesla at frequencies of 5000 Hz. The alloys are useful in high, performance transformers due to their high flux density, high saturation induction, high Curie temperature, high permeability, and low coercivity. The alloys are useful as laminated material for electrical engines and generators wherein the operating temperatures are on the order of 200° C. and higher. The alloys can also be used for pole tips for high field magnets-because the alloys-exhibit-normal permeability at high induction. The alloys can be used for magnetically driven actuators in devices such as impact printers because the alloys exhibit low magnetic losses under rapidly fluctuating electric current. Because of their high normal permeability and high incremental permeability at high induction, as well as exhibiting suitable mechanical properties, the alloys are useful as diaphragms in telephone handsets. The alloys can be used as solenoid valves of armature-yoke systems in diesel direct injection fuel systems because the alloys exhibit sufficient strength to withstand high fuel pressure. Because the alloys exhibit low eddy current losses (high resistivity, therefore the alloys can be used at higher operating frequencies), they are useful as magnetically actuated parts such as solenoid cores and fast response magnetic switches or in magnetically excited circuits operating at high frequencies.

Compared to commercial Fe—Co—V alloys, some preferred alloys are more economical due to their lower Co content, higher strength at room temperature and elevated temperatures such as 600° C., and/or good to excellent room temperature ductility in the ordered state while exhibiting comparable creep resistance and magnetic properties. In addition, preferred alloys exhibit higher resistivity and better oxidation resistance compared to the commercial Fe—Co—V alloys. The improved temperature dependent strength properties, magnetization saturation, and eddy loss performance can provide advantages over known alloys in current commercial applications such as electric generator pole shoes, high performance motors, and aerospace applications.

Parts made of the high strength soft magnetic Fe—Co alloys described herein can be formed by techniques such as casting (e.g., sand casting, investment casting, gravity casting, etc.), forging (e.g., impact forging or the like), or powder processing (e.g., sintering elemental or pre-alloyed powders).

A cast soft magnetic Fe—Co alloy part can be made by any suitable casting technique such as sand casting, investment casting, gravity casting or the like. The investment casting process comprises steps of melting an Fe—Co alloy composition, filling a mold with the molten metal, cooling the molten metal so as to form at least a portion of a cast part, and removing the part from the mold. For example, a complicated part can be cast in a single part or in two or more parts which are later joined by welding, brazing or the like to form the completed part. Also, the casting step can be carried out in an inert gas atmosphere such as argon. The investment casting process can carried out by any suitable technique. See, for example, "Investment Casting" by Robert A. Horton, ASM Handbook Ninth Edition entitled "Casting", Volume 15, 1988, pages 253-269, the disclosure of which is hereby incorporated by reference.

For instance, the alloy can be cast into a billet. Casting is preferably done in a low partial pressure oxygen atmosphere because oxygen is deleterious to magnetic properties of the alloy. The oxygen partial pressure during casting is preferably less than 0.005%. The billet can be forged at a temperature of 900 to 1100° C. to break down the cast structure, the forging can be hot rolled to form a sheet, the hot rolled-sheet can be quenched from a high temperature on the order of 950° C. into an ice brine solution below 0° C. so as to form a sheet having a disordered crystal structure, the sheet can be cold rolled to a desired size (e.g., the sheet can be rolled with reductions of 60 to 90% to, for example, a thickness of from between 5 to 100 mil), and the cold rolled sheet can be annealed, e.g., the alloy can be age hardened or precipitation hardened at 400 to 700° C. for up to 50 hours in air. The alloy can be manipulated to its final shape either before or after age hardening.

According to one embodiment, Fe—Co—V alloy sheets are prepared by casting. Each alloy is melted via non-consumable electrode arc melting under a positive pressure of argon and drop-cast into ingots. Cast ingots are sectioned into individual samples measuring 0.5×1×0.5 inches, except as noted below. By way of example, the samples are then encapsulated with a steel cover and processed into 0.03 inch thick sheets according to the following table:

TABLE 4

| Alloy(s) | Processing |
|---|---|
| SM-1 | hot roll to 0.075" at 1100° C.;<br>warm roll to 0.03" at 900° C. |
| SM-2-SM-5 | hot roll to 0.18" at 950° C.;<br>cold roll to 0.03" (intermediate 950° C. anneal in some cases) |
| SM-6 | hot forge to 0.25" at 1100° C.;<br>hot roll to 0.08" at 1100° C.;<br>warm roll to 0.03" at 900° C. |
| SM-7 | 1 × 1" ingot, hot forge to 0.5" at 1000° C.;<br>hot roll to 0.08" at 1100° C.;<br>warm roll to 0.03" at 900° C. |
| SM-8-SM-12 | hot forge to 0.25" at 1100° C.;<br>hot roll to 0.08" at 1100° C.;<br>warm roll to 0.03" at 900° C. |
| SM-10-CW | hot forge to 0.25" at 1100° C.;<br>hot roll to 0.08" at 1100° C.;<br>anneal 10 min. at 1100° C.;<br>ice brine quench;<br>cold roll to 0.03" |
| SM-13 | 1 × 1" ingot, hot forge to 0.5" at 1000° C.;<br>hot roll to 0.25 at 950° C;<br>hot roll to 0.08" at 1100° C.;<br>cold roll to 0.03" |

To minimize the eddy current losses during alternative current applications the components such as the rotor and stator are formed by stacking thin sheets separated by an insulating layer. In general, cold-rolling is done as a final processing step to attain the desired thin gauge sheets. The alloys are amenable to cold-rolling and can be prepared in thin gauges. By way of example, processing steps to produce thin gauge sheets for cold-roiled alloys SM9 and SM24 are given in Table 5.

TABLE 5

| Final Thickness (mils) | Processing Details |
|---|---|
| 30 | cut 1 inch piece from the cast ingot<br>encapsulate alloy with steel cover<br>hot forge at 1100° C. to 0.25 inch<br>hot roll at 1100° C. to 0.16 inch<br>anneal at 950° C./30 min in Ar atmosphere<br>ice brine quench<br>cold roll to 0.03 inch |
| 15 | cut 1 inch piece from the cast ingot<br>encapsulate alloy with steel cover<br>hot forge at 1000° C. to 0.25 inch<br>hot roll at 1100° C. to 0.11 inch<br>anneal at 950° C./30 min in Ar atmosphere<br>ice brine quench<br>cold roll to 0.015 inch |

TABLE 5-continued

| Final Thickness (mils) | Processing Details |
|---|---|
| 5 | cut 1 inch piece from the cast ingot<br>encapsulate alloy with steel cover<br>hot forge at 1000° C. to 0.25 inch<br>hot roll at 1100° C. to 0.06 inch<br>anneal at 950° C./30 nun in Ar atmosphere<br>ice brine quench<br>cold roll to 0.005 inch |

In addition to increasing the electrical resistivity of the alloy, another way to minimize eddy current losses is to stack the alloy in the form of thin sheets, separated by insulating layers. As shown above, thin sheets of the alloys have been successfully formed using conventional processing techniques. For instance, alloys are initially forged or rolled at temperatures greater than $\alpha-\gamma$ transformation temperatures, e.g. greater than 1000° C. in order to breakdown the cast microstructure. The alloys are hot rolled, for example at temperatures of about 900° C. to an intermediate thickness, and cold rolled to the final thickness. By way of example, SM-10-CW was initially rolled to a thickness of 0.08 inches, exposed to a disordering treatment (1100° C./10 min. followed by ice brine quench), and then cold rolled into 0.03 inch thick sheets. Quenching the alloy from elevated temperature in order to retain a disordered state is a prerequisite for cold rolling. Ease of cold rolling depends on the prior microstructure. A two phase structure ($\alpha_2+\gamma$), formed by quenching from the $\alpha+\gamma$ phase is more readily cold workable as compared to structures produced by quenching from single phase $\alpha$ or $\gamma$.

A forged Fe—Co alloy part can be made by any suitable forging technique such as precision forging, isothermal and hot-die forging. The forging process comprises steps of using a member such as a punch and/or die to form an Fe—Co alloy composition into a desired shape. The Fe—Co alloy can be in the form of a loose or compacted powder or a monolithic body such as a section of an extruded billet, casting or the like. The Fe—Co can be hot forged at temperatures of 800° C. and above. If an Fe—Co alloy powder is used, the powder can be canned in mild steel which is removed after the forging step. The forging process can carried out by any suitable technique. See, for example, "Forging Processes" by G. D. Lahoti, ASM Handbook Ninth Edition entitled "Forming and Forging", Volume 14, 1988, pages 59-212, the disclosure of which is hereby incorporated by reference.

A Fe—Co alloy part could be formed by machining the part from a piece of cast, hot worked, cold worked, annealed, sintered or otherwise processed Fe—Co alloy material. For example, the part could be machined from a billet of Fe—Co alloy material. The Fe—Co alloy could be heat treated before and/or after machining to provide desired mechanical properties of the alloy.

A sintered Fe—Co alloy part can be made by any suitable powder metallurgical technique such as slip casting, freeze casting, injection molding, die compaction or the like. The process can include powder compaction (e.g., cold pressing, warm compaction, hot compaction, isostatic pressing, forging, etc.) to form a shaped part of an Fe—Co alloy composition, and heating the shaped part to a temperature sufficient to achieve sintering the powders together. For example, a complicated part can be formed in a single part or in two or more parts which are later joined by welding, brazing or the like to form the completed part. The compaction and sintering process can be carried out by any suitable technique. See, for example, "Powder Shaping and Consolidation Technologies" by B. Lynn Ferguson and Randall M. German, ASM Handbook Ninth Edition entitled "Powder Metal Technologies and Applications", Volume 7, 1988, pages 311-642, the disclosure of which is hereby incorporated by reference.

In the powder metallurgical process, the alloy can be atomized to form an alloy powder with, for example, particle sizes of from between 100 nm to 30 microns. The atomized powder can be mixed with a binder and the powder mixture can be formed into a desirable shape such as a sheet by roll compaction or tape casting. The sheet can be heated to volatilize the binder followed by partial sintering. The partially sintered sheet can be cold rolled to a desired thickness, and the cold rolled sheet can be annealed, e.g., age hardened, in either an oxidizing or reducing atmosphere. If desired, the atomized powder can be formed into a sheet by plasma spraying and the plasma sprayed sheet can be cold rolled and annealed such as by age hardening or solid solution hardening to produce a sheet that displays superior creep resistance. In addition to using atomized powder for the roll compaction/tape casting/plasma spraying process described above, the atomized powder can be mechanically alloyed to include an oxide dispersoid therein, such as $Y_2O_3$. In addition to $Y_2O_3$, other oxides which can be added to the alloy include chromia, alumina, vanadium oxide, zirconia, cordierite, mullite, niobium oxide, or combinations thereof. The powder mixture can be ground with suitable grinding media such as zirconia or stainless steel balls for an appropriate period of time such as 2-20 hours so as to achieve a desired particle size and obtain a uniform distribution of oxide particles in the ground mixture. The powder mixture can be processed as described above, and after the heat treatment the sheet can have an oxide content of 0.5 to 4 wt. % and/or an average grain size of 1 to 30 microns.

In making laminated products with the sheet, it may be desired to include an insulating barrier between layers. Such an insulating barrier can be provided by applying a thin film coating on the surfaces of the sheet. For instance, an insulating material such as iron aluminide (insulating at elevated temperatures) can be applied to the sheet by any suitable technique such as sputtering or magnetron sputtering, cathodic arc deposition, chemical vapor deposition, plasma spraying, or electroless plating, etc. Alternatively, an oxide coating such as alumina can be provided on the sheet by any suitable technique such as sol gel processing. The thus coated sheets can be assembled into a laminated article and held together by any suitable technique, e.g., mechanically attached by suitable clamping or metallurgically bonded by brazing, etc. Alternatively, a surface oxide layer may be added by oxidizing the sheet in air or other oxidizing ambient. The surface oxide, regardless of the deposition means, is preferably deposited at a thickness of from between 1 to 10 microns.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A soft magnetic Fe—Co alloy consisting of, in weight %,
Fe and Co such that the difference between the Fe and Co is at least 2%,
at least 35% Co,
4% to 4 5% V,
0.0005 to 0.002% B, and
balance Fe.

2. The alloy of claim 1, wherein the alloy consists of about 41.5% Co, 54% Fe, 4.5% V and 0.001% B and exhibits a room temperature ultimate tensile strength of at least 800 MPa, a room temperature yield strength of at least 600 MPa, a yield strength at 600° C. of at least 500 MPa, a rupture life at 600° C. under a stress of at least 600 MPa of at least 24 hours and/or a total elongation at room temperature of at least 3.5%;

wherein the alloy exhibits a total elongation at 600° C. of at least 7.5% and room temperature saturization magnetization of at least 190 emu/g.

3. The alloy of claim 1, wherein the alloy exhibits creep resistance at 600° C. under a stress of at least 500 MPa of 6×10−7/sec or lower, a weight gain of 1.5 mg/cm$^2$ or less when exposed to air for 100 hours at 600° C. and an electrical resistivity at 600° C. of at least 55 μohm-cm.

4. The alloy of claim 1, comprising a part of a high performance transformer, a laminated part of an electrical generator, a pole tip of a high field magnet, a magnetically driven actuator of a device such as an impact printer, a diaphragm of a telephone handset, a solenoid valve of an armature-yoke system of a diesel injection engine, a magnetostrictive transducer, an electromagnetically controlled intake or exhaust nozzle, a flux guiding part of an inductive speed counter of an anti-lock brake system, a magnetic lens, a solenoid core of a magnetic switch or part of a magnetically excited circuit.

5. The alloy of claim 1, in a condition of being cold rolled into a sheet.

6. The alloy of claim 1, having an ultimate tensile strength between 1000 and 1400 MPa at room temperature, and between 800 and 1000 MPa at 600° C.

7. The alloy of claim 1, having a yield strength between 850 and 1100 MPa at room temperature, and between 750 and 900 MPa at 600° C.

8. The alloy of claim 1, having a tensile elongation between 1 and 6% at room temperature, and between 8 and 10.5% at 600° C.

9. The alloy of claim 1, having a saturation magnetization between 190 and 200 emu/g at room temperature, and between 180 and 200 emu/g at 600° C.

10. The alloy of claim 1, having a coercivity between 45 and 70 Oe at room temperature, and between 40 and 60 Oe at 600° C.

11. The alloy of claim 1, having a resistivity between 50 and 60 microOhm-cm at room temperature, and between 75 and 85 microOhm-cm at 600° C.

12. A method of manufacturing the alloy of claim 1, comprising:

preparing a powder mixture by mixing powder of the alloy with a binder, forming the powder mixture into a sheet, forming a sintered sheet by heating the sheet so as to remove the binder and sinter the powder, forming a rolled sheet by cold rolling the sintered sheet, and heat treating the rolled sheet;

plasma spraying powder of the alloy into a plasma sprayed sheet, forming a cold rolled sheet by cold rolling the plasma sprayed sheet and heat treating the cold rolled sheet;

mechanically alloying powder of the alloy with oxide particles to form an alloyed powder, forming the alloyed powder into a sheet, forming a cold rolled sheet by cold rolling the sheet, and age hardening the cold rolled sheet;

strengthening the alloy through solid solution hardening and/or precipitation strengthening; or forming a hot worked article by hot working the alloy at a temperature of at least 900° C., annealing the hot worked article in the temperature range of 900° C. to 1100° C. for 10 min. followed by quenching the hot worked article in an ice brine solution and cold rolling the hot worked article.

13. A method of manufacturing the alloy of claim 1, comprising:

forming the alloy into a magnetic bearing by casting the alloy or sintering powders of the alloy; and/or forming the alloy into a part of a high performance transformer, a laminated part of an electrical generator, a pole tip of a high field magnet, a magnetically driven actuator of a device such as an impact printer, a diaphragm of a telephone handset, a solenoid valve of an armature-yoke system of a diesel injection engine, a magnetostrictive transducer, an electromagnetically controlled intake or exhaust nozzle, a flux guiding part of an inductive speed counter of an anti-lock brake system, a magnetic lens, a solenoid core of a magnetic switch or part of a magnetically excited circuit.

14. A method of manufacturing the alloy of claim 1, comprising:

casting the alloy at an oxygen partial pressure less than 0.005%;

forming the alloy into a sheet and rolling the sheet to a thickness of 5 to 100 mils;

forming the alloy into a sheet, hot rolling the sheet at a temperature of at least 950° C., quenching the sheet from at least 950° C., and then cold rolling the sheet to a thickness in the range of 0.002 to 0.03 inches;

forming the alloy into a sheet and annealing the sheet at a temperature of at least about 950° C. during cold rolling of the sheet;

casting the alloy and forging or rolling the cast alloy into a sheet at a temperature greater than 1000° C. so as to break down the cast microstructure;

forming the alloy into powder having a particle size of 100 nanometers to 30 microns; and/or optionally cold rolling the alloy followed by annealing the alloy at a temperature in the range of 850 to 1000° C., water quenching the alloy, and aging the alloy at a temperature in the range of 600 to 700° C. so as to provide the alloy with a room temperature ultimate tensile strength of at least 1000 MPa.

* * * * *